United States Patent [19]

Takeuchi et al.

[11] 4,381,722

[45] May 3, 1983

[54] SEWING MACHINE

[75] Inventors: Toshikatu Takeuchi, Anjo; Kihei Goto, Konan; Yasuro Ichihashi, Inazawa; Takenori Kawase, Gifu, all of Japan

[73] Assignee: Brother Kogyo Kabushiki Kaisha, Japan

[21] Appl. No.: 259,983

[22] Filed: May 4, 1981

[30] Foreign Application Priority Data

May 13, 1980 [JP] Japan ..... 55-63131
May 20, 1980 [JP] Japan ..... 55-67008

[51] Int. Cl.[3] ..... D05B 29/02; D05B 71/00
[52] U.S. Cl. ..... 112/235; 112/256
[58] Field of Search ..... 112/235, 256, 237, 238, 112/239

[56] References Cited

U.S. PATENT DOCUMENTS 2,541,888 2/1951 Pinkvoss ..... 112/235
2,750,908 6/1956 Odermann et al. ..... 112/235

*Primary Examiner*—H. Hampton Hunter
*Attorney, Agent, or Firm*—Leydig, Voit, Osann, Mayer & Holt, Ltd.

[57] ABSTRACT

In a sewing machine having a presser foot and a pressure imparting member for applying a downward pressure to the presser foot, there is disposed, in an inner chamber of a frame, an oil pump drivingly connected to a main shaft. The oil pump having an inlet port for drawing the oil from an oil reservoir and an outlet port for deliverying the oil under the pressure corresponding to the speed of the main shaft. Also a presser actuating device is provided between the oil pump and the presser foot and designed to apply an additional downward pressure to the presser foot by means of the oil from the outlet port so as to increase the downward pressure of the presser foot.

11 Claims, 28 Drawing Figures

SEWING MACHINE

FIELD OF THE INVENTION

This invention relates to a sewing machine and more particularly to such machine wherein a downward pressure corresponding to an occasional speed of a main shaft may be applied to a presser foot.

BACKGROUND OF THE INVENTION

In a sewing machine of the prior art wherein a work may be fed on a work supporting surface through cooperation between a feed dog and a presser foot, provision is made of a pressure imparting spring designed for applying a downward pressure to the presser foot and of manual adjusting means for adjusting the pressure of the spring. In advance of the stitching operation, the downward pressure is set or adjusted in dependence upon the quality and/or thickness of the work so as to effect the stitching operation under such preset condition.

In present-day, however, over edge sewing machines have a tendency to be operated at higher and higher speed, and high speed sewing machines with the rotational speed of the main shaft approaching to 10,000 r.p.m. are now offered to the market. With such high speed machines, various adverse effects may be caused to exist when the sewing is carried out under the same downward pressure conditions as preset at the start of stitching operation. That is to say, when the downward pressure has been set to a higher value suited for high speed operation, the downward pressure thus set may act strongly on the work to mar the same during the starting or on the occasion of low speed operation of the machine in the course of stitching operation. Conversely, when the downward pressure has been set to a lower value suited for low speed operation, should the sewing machine be operated at some higher speed during stitching operation, the presser foot may float on account of high speed operation of the feed dog, thus interfering with the smooth feed of the work.

In order to provide the machine with a solution to such problems, "Speed responsive presser device for sewing machines" has been proposed in the art such as shown in the specification and drawings of the U.S. Pat. No. 2,541,888.

However, in this speed responsive presser device, use is made of a mechanical governor on the main shaft for imparting to the presser foot a downward pressure corresponding to the speed of the main shaft of the sewing machine. Such governor, however, is not suitable for use on the present-day high speed sewing machines with the rotational speed of the main shaft approaching to 10,000 r.p.m. and thus incapable of producing a downward pressure accurately responsive to the main shaft speed. Moreover, such mechanical governor has much to be desired as to durability, noise generation and so forth.

"Fluid pressure actuated mechanism for sewing machines" is also known as disclosed in the specification and drawings of the U.S. Pat. No. 2,750,908.

In this fluid actuated mechanism, the air from an air pump mounted to the output shaft of the power transmitter having a clutch and brake is conducted to an air cylinder mounted on an arm of the sewing machine to impart the downward pressure to the presser foot through such air cylinder. In consideration that the air has compressibility markedly higher than that of liquids, it is by no means feasible to impart to the presser foot a downward pressure accurately responsive to the high speed of the main shaft approaching to 10,000 r.p.m. as encountered in present-day sewing machines.

Further, said air pump is mounted on the output shaft of the power transmitter and a long and thick flexible hose must be used to interconnect said air pump and the air cylinder mounted on the arm of the sewing machine. Hence, the number of component parts may be increased, thus not only resulting in increased manufacture costs but detracting from the overall appearance of the sewing machine.

In view of demands of the times on the enhanced operational speed of the sewing machine and resulting improvement in operational efficiency, the present inventors have conducted a variety of researches and experiments, and devised a sewing machine free of the above deficiencies of the prior art.

SUMMARY OF THE INVENTION

It is a principal object of the present invention to provide a sewing machine capable of accurately imparting to the presser foot a downward pressure corresponding to main shaft speeds at all times from the start of the stitching operation to high speed operation approaching to 10,000 r.p.m.

Such object of the present invention may be attained by a sewing machine to the presser foot of which is imparted a downward pressure from pressure imparting means, wherein an oil pump is disposed in an inner chamber of the frame and drivingly connected to the main shaft, and presser actuating means including an oil cylinder are provided between said oil pump and presser foot for applying an additional downward pressure to the presser foot by means of the oil from an outlet port of the oil pump.

This may be rendered possible by the fact that a liquid such as oil has much smaller compressibility than air.

It is also an object of the present invention to provide a sewing machine which does not lead to increased costs notwithstanding its superior responsive properties.

This may be rendered possible by the fact that the oil of the oil reservoir necessarily provided in high speed sewing machines for lubrication of various movable parts is available to the oil pump and hence any special oil reservoir need not be installed in case of using such oil pump for imparting the downward pressure to the presser foot, or that such oil pump may be disposed in the inner chamber of the frame and drivingly connected to the main shaft for simplifying any connecting structure.

It is also an object of the present invention to provide a sewing machine wherein, until such time that the rotational speed of the main shaft has attained a predetermined value, a downward pressure is imparted from pressure imparting means to the presser foot, such downward pressure being increased correspondingly in case the main shaft speed has exceeded a predetermined value; a certain downward pressure is applied to the work during standstill and starting depending on the work thickness to prevent the deviation of the work; and wherein such downward pressure may be modified during stitching operation responsive to the rotational speed of the main shaft and hence that of the feed dog to feed the work for realizing an optimum work feed.

It is also an object of the present invention to provide a sewing machine capable of being adapted to work kinds or thicknesses or other conditions by providing control means for varying the increasing rate of said additional downward pressure relative to the speed of said main shaft.

It is also an object of the present invention to provide a sewing machine wherein a first oil pump for delivering the oil to moving parts of the sewing machine and a second oil pump for imparting the downward pressure to the presser foot may readily be installed in the inner chamber of the frame without requiring much space.

It is also an object of the present invention to provide a sewing machine that may be manufactured at reasonable costs by having a piston mounted in a cylindrical chamber provided to a pump casing of the oil pump adapted to impart the downward pressure to the presser foot.

BRIEF DESCRIPTION OF THE DRAWINGS

FIGS. 1 to 13 show a first embodiment of the present invention, wherein

FIG. 1 is a sectional side elevation showing substantial parts of an over edge sewing machine;

FIG. 2 is an enlarged partial section taken along line 2—2 of FIG. 1;

FIG. 3 is an enlarged partial section taken along line 3—3 of FIG. 1;

FIG. 4 is a partial section taken along line 4—4 of FIG. 3;

FIG. 5 is a sectional plan view, shown to a reduced scale, showing the sewing machine of FIG. 1;

FIG. 6 is a partial section taken along line 6—6 of FIG. 5;

FIG. 7 is a partial section taken along line 7—7 of FIG. 5;

FIG. 8 is a section taken along line 8—8 of FIG. 7;

FIG. 9 is an enlarged partial section taken along line 9—9 of FIG. 7;

FIG. 10 is an enlarged partial section taken along line 10—10 of FIG. 7;

FIG. 11 is a partial section taken along line 11—11 of FIG. 6;

FIG. 12 is a bottom view of a first oil pump taken along line 12—12 of FIG. 6;

FIG. 13 is a chart showing the change in downward pressure as plotted against the main shaft speed;

FIGS. 14 to 28 show a second embodiment of the present invention, wherein FIG. 14 is a sectional side elevation showing substantial parts of an over edge sewing machine;

FIG. 15 is an enlarged partial section along line 15—15 of FIG. 14;

FIG. 16 is an enlarged partial section along line 16—16 of FIG. 14;

FIG. 17 is a sectional plan view, shown to a reduced scale, showing the sewing machine of FIG. 14;

FIG. 18 is a partial section taken along line 18—18 of FIG. 17;

FIG. 19 is a partial section taken along line 19—19 of FIG. 17;

FIG. 20 is a partial section taken along line 20—20 of FIG. 19;

FIG. 21 is an enlarged partial section taken along line 21—21 of FIG. 19;

FIG. 22 is an enlarged partial section taken along line 22—22 of FIG. 19;

FIG. 23 is a partial section taken along line 23—23 of FIG. 18;

FIG. 24 is a bottom view of a first oil pump taken along line 24—24 of FIG. 18;

FIG. 25 is a partial section, shown to a reduced scale and taken along line 25—25 of FIG. 14;

FIG. 26 is a partial section taken along line 26—26 of FIG. 25;

FIG. 27 is an enlarged partial section taken along line 27—27 of FIG. 25; and FIG. 28 is a chart showing the change in downward pressure as plotted against the main shaft speed.

DESCRIPTION OF PREFERRED EMBODIMENTS

Reference is made to FIGS. 1 to 13 illustrating the first embodiment of the present invention as applied to an over edge sewing machine.

Figure 1:
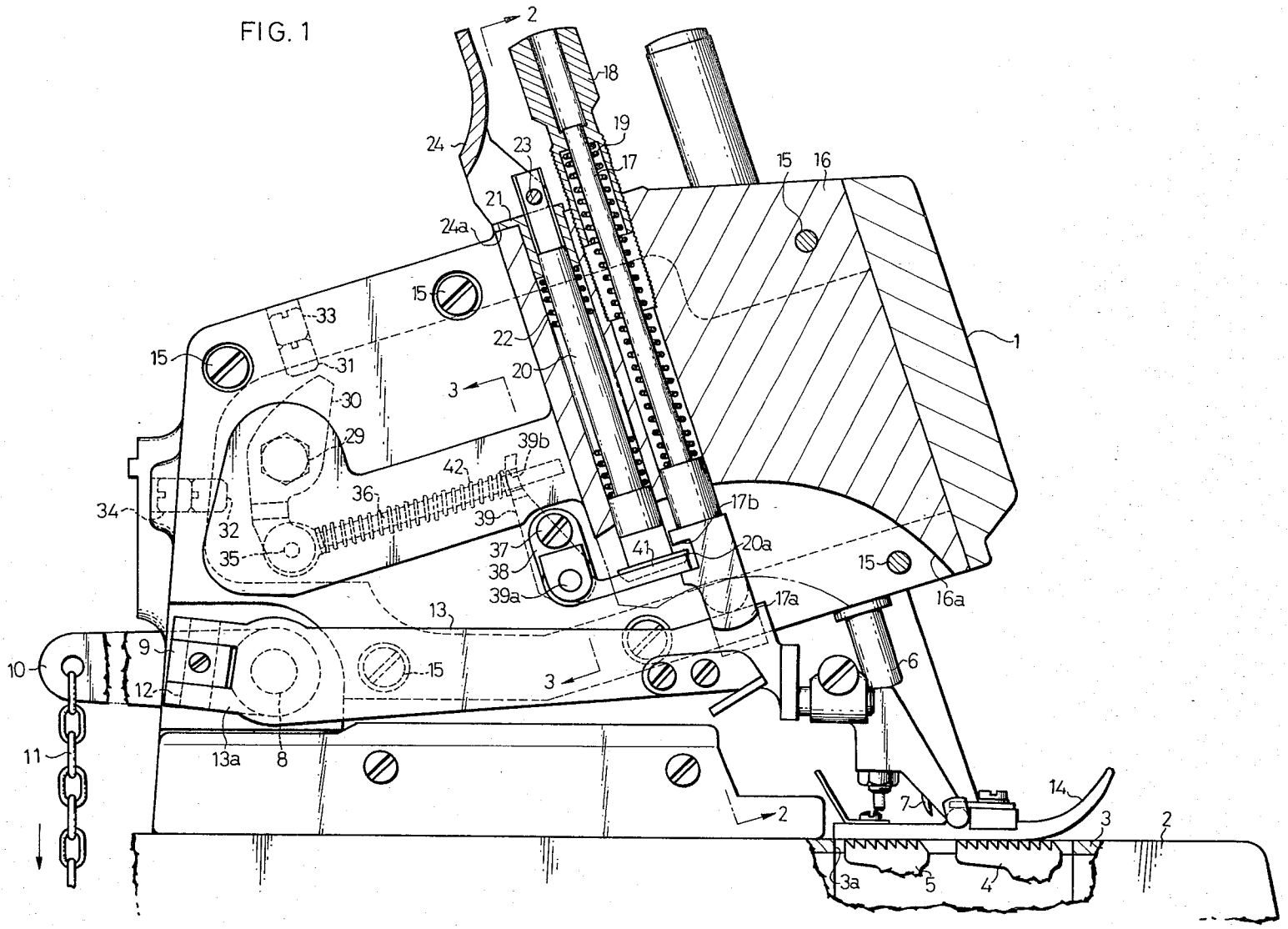
Figure 4:
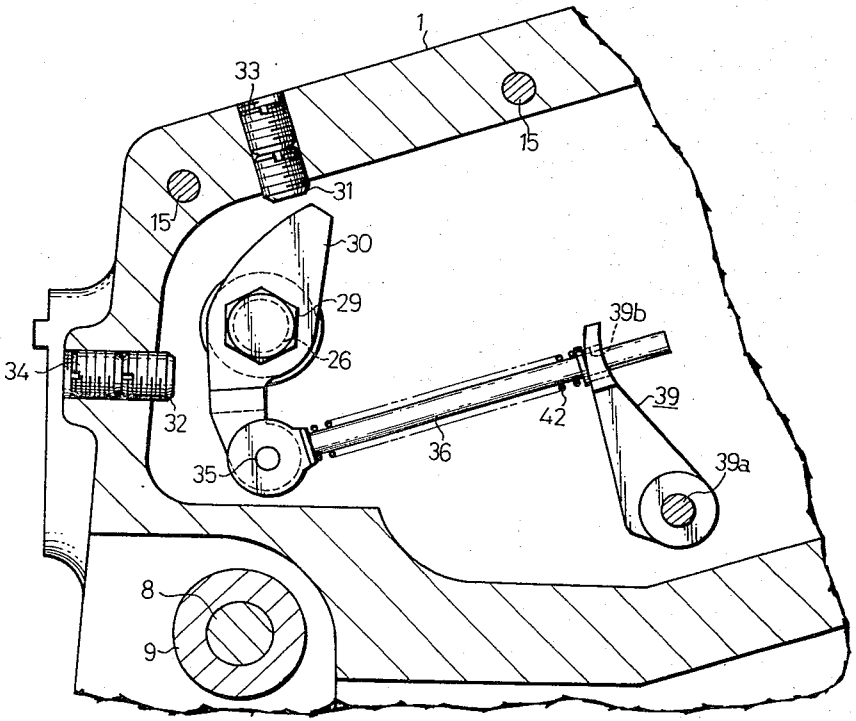
Figure 5:
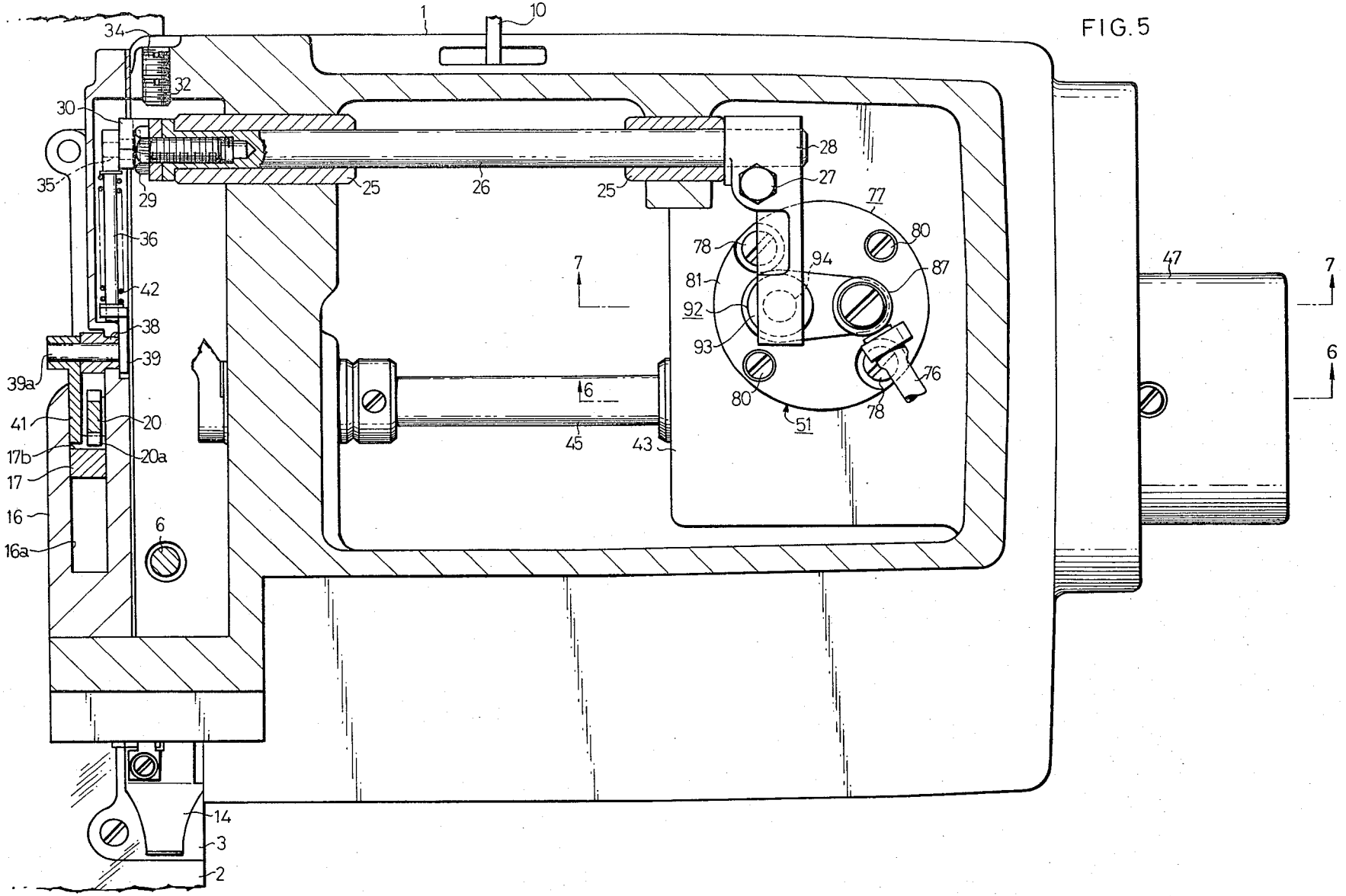

As shown in FIGS. 1 and 5, a throat plate 3 is mounted on the upper surface of a lower portion of a frame 1 and are designed to provide a work supporting surface 2 in cooperation with the frame 1. Said throat plate 3 having a needle aperture (not shown) and a slot **3*a* for the passage of feed dog means. Also, as shown in FIGS. 4 to 8, the frame 1 has an inner chamber for accomodating various moving parts of the machine. A main feed dog 4 and an auxiliary feed dog 5 are disposed within the frame 1 below said throat plate 3 and are designed to perform a four-stage feed motion so as to emerge from and exit into slot 3*a* on the plate 3 to effect the feed of the work supported on the surface 2. Above said throat plate 3, a needle bar 6 is mounted for vertical travel within a head portion of the frame 1, and a needle 7, mounted to the lower end of the needle bar 6, is designed to form over edge stitches on the work in cooperation with a looper mechanism (not shown) mounted within the frame 1 below the throat plate 3**.

As shown in FIG. 1, at the back of the frame 1, a rotary shaft 8 is mounted for rotation about a horizontal axis, and fixedly mounts at one end a rotary arm 9. A presser lifting lever 10 is secured to the other end of the rotary shaft 8, being connected by chain 11 to a lifting pedal (not shown). A supporting arm 13 is mounted to said rotary arm 9 at a rear bifurcate portion **13*a* by a pin 12 for transverse rotation. A presser foot 14 is mounted to the front portion of the arm 13 to effect the feed of the work on the surface 2 through cooperation with said feed dogs 4 and 5. With the above construction, upon the downward actuation of said lifting pedal, said supporting arm 13 is rotated counterclockwise from the position of FIG. 1, by way of the chain 11, the rotary shaft 8 and the rotary arm 9, and the presser foot 14 is lifted away from the work supporting surface 2. Upon rotation of the supporting arm 13 sidewise about the pin 12, the presser foot 14 is receded sidewise away from the position corresponding to said feed dogs 4 and 5**.

As shown in FIGS. 1, 2, 3 and 5, a cover plate 16 is secured to the left hand side of the head portion of the frame 1 by plural screws 15, with a recess **16*a* formed in the front lower end of the plate 16 so as to open downwards and backwards. A presser bar 17 is passed through substantially the center of the cover plate 16 for free vertical travel, said presser far 16 having, at the lower end thereof, a bifurcate portion 17*a* designed to engage with an upper front end of the supporting arm 13 and, on the lower rear surface, a recessed engaging portion 17*b*. On top of the presser bar 17, a manual adjusting knob 18 is rotatably screwed onto the upper end of the cover plate 16 for manually adjusting a downward pressure of the presser foot 14 as desired. A pressure imparting spring 19 is interposed between the knob 18 and the presser bar 17 for imparting a downward pressure to the presser foot 14 through the presser bar 17 and supporting arm 13 in accordance with the spring force preset by the knob 18**.

At the back of said presser bar 17, a pressure releasing bar 20 is passed through and carried by the cover plate 16 for free vertical movement and has an engaging projection 20*a* at the lower end thereof for engaging with an engaging portion 17*b* of the presser bar 17 within recess 16*a* of the cover plate 16. A compression spring 22 is interposed between a washer 21 at the upper end of cover plate 16 and the pressure releasing bar 20 for pressing the bar 20 downwardly. A pressure releasing lever 24 is rotatably mounted by a pin 23 to the upper end of the pressure releasing bar 20. With the above construction, when the lever 24 has been turned counterclockwise from the position of FIG. 1, the bar 20 is raised by operation of a cam portion 24*a* for lifting the presser bar 17 so as to release the pressure of the spring 19 on the pressor foot 14.

Figure 7:
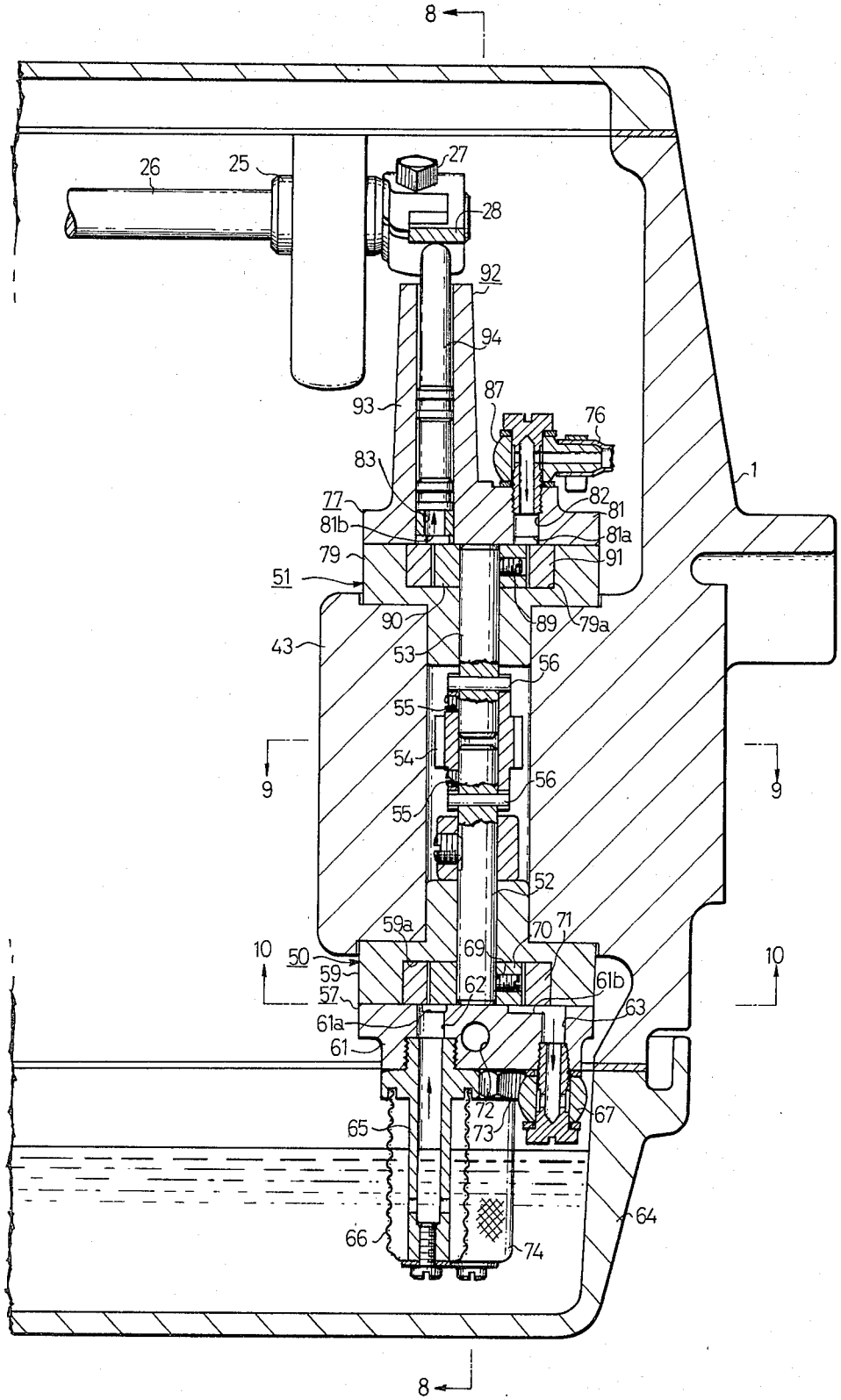
Figure 8:
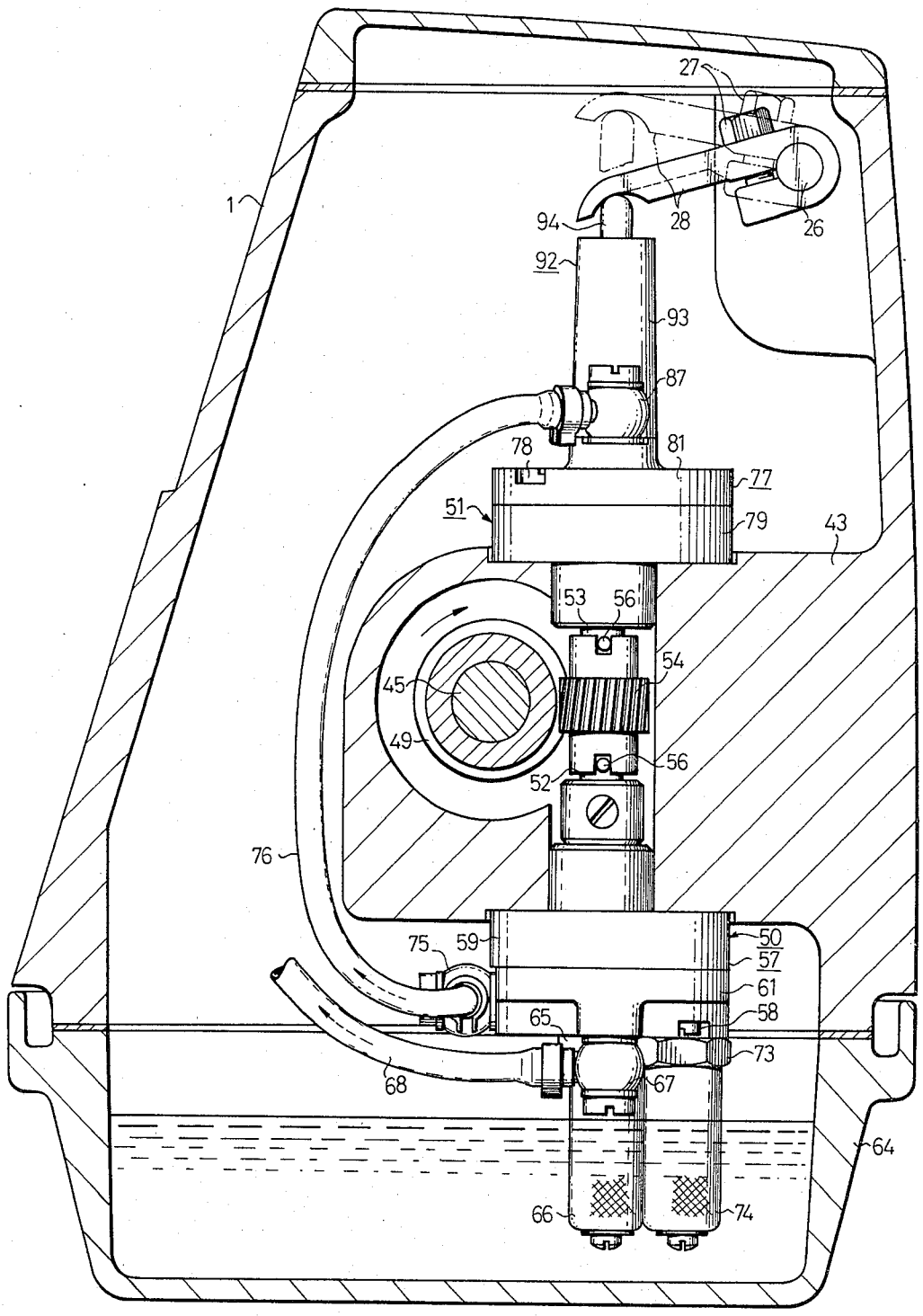
Figure 9:
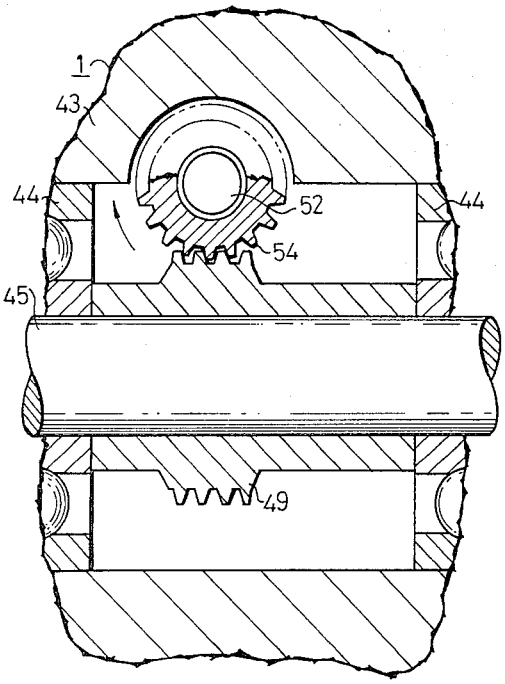

As shown in FIGS. 5, 7 and 8, in the upper rear portion of the frame 1, there is mounted a rotary shaft 26 through a hair of bearings 25 for rotation about a horizontal axis. An operating lever 28 is secured by bolt 27 to the right hand extremity of the shaft 26 while a rotary lever 30 is secured at about a mid point by a bolt 29 to the left hand extremity of the shaft 26. As shown in FIGS. 1 and 4, a pair of limiting screws 31 and 32 are adjustably screwed to the upper and rear portions respectively of the frame 1 in positions corresponding to the upper and lower arm portions of the rotary lever 30, and may be suitably secured by screws 33 and 34 for limiting the extent of swinging of the rotary lever 30. To the lower arm portion of the rotary lever 30, there is mounted a connecting rod 36 by a stepped screw 35 for rotation about its own axis, with the front portion of the rod 36 extending forwardly.

Figure 3:
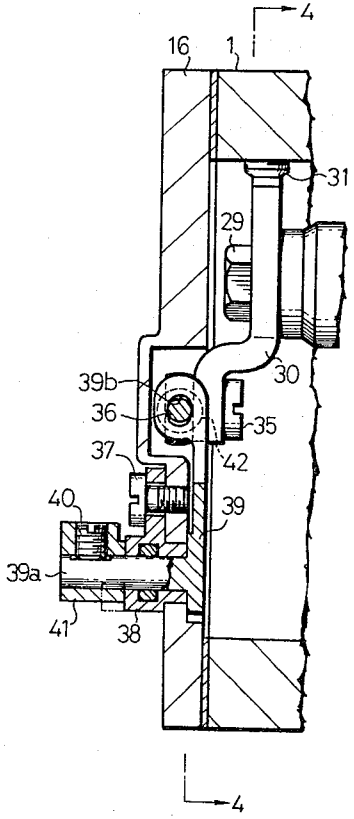
Figure 2:
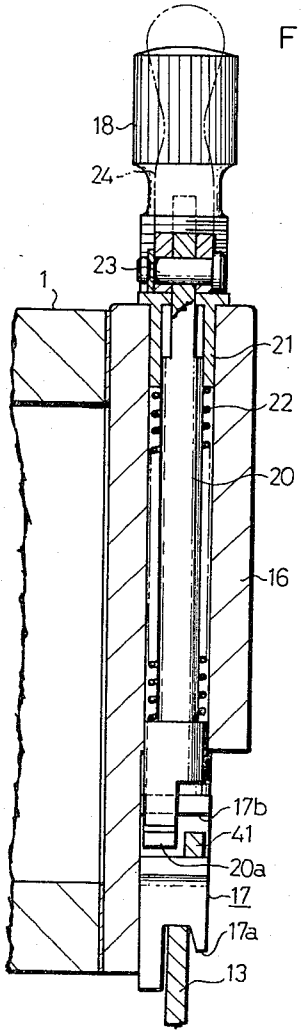

As shown in FIGS. 1, 3 and 5, a supporting member 38 is mounted by a screw 37 to the left hand surface of the cover plate 16 in the vicinity of the front end of the connecting rod 36. Inside the cover plate 16, a lever 39 is mounted rotatably at the lower shaft portion 39*a* through a support boss of the supporting member 38, the upper end of the lever 39 having a lengthy aperture 39*b* into which the foremost part of the rod 36 has a loose fit. A pressure imparting lever 41 is secured by a screw 40 to the outer end of the shaft portion 39*a* of the lever 39. As shown in FIGS. 1 and 2, the foremost part of the lever 41 is intruded into the recess 16*a* of the cover plate 16 to engage with the engaging portion 17*b* of the presser bar 17. A motion transmitting spring 42 is mounted on the connecting rod 36 between the levers 30 and 39. When the lever 30 has been turned by the rotary shaft 26 counterclockwise as shown in FIGS. 1 and 4, the pressure imparting lever 41 is turned clockwise by the lever 39 after compression of the spring 42 to a predetermined degree. Hence a downward pressure is applied to the presser foot 14 in dependence upon the amount of rotation of the shaft 26 and acts cumulatively with the downward pressure applied by the spring 19.

According to the present embodiment, the amount of rotation of the shaft 26 is determined in response to the rotational speed of a main shaft for changing the downward pressure of the presser foot 14. Thus, as shown in FIGS. 5 to 9, a boss 43 is provided on the right hand inner surface of the frame 1, and the main shaft 45 is mounted in the frame 1 by plural bearings 44 so as to pass through said boss 43 and to be rotated about a horizontal axis. A pulley 47 is secured by a bolt 46 to the right hand extremity of the shaft 45, and a belt 48 is placed between the pulley 47 and an electric motor (not shown) having clutch means. Upon actuation of a foot pedal operatively connected to the motor, and resulting connection of the clutch means, the main shaft 45 is rotated clockwise in FIG. 8 by way of the belt 48 and pulley 47 for driving the moving parts of the sewing machine including said feed dogs 4, 5 and needle bar 6. Inside the boss 43 of the frame 1, a helical drive gear 49 is fitted securely on the main shaft 45 for rotation in unison with the main shaft 45.

A first oil pump 50 and a second oil pump 51, both of which are trochoid pumps, are mounted to the upper and lower surfaces respectively of the boss 43 within the frame 1, with pump shafts 52 and 53 extending towards the interior of the boss 43, at back of the main shaft 45, with their axes being coincident and arranged vertically. A helical driven gear 54 is mounted between the foremost parts of the pump shafts 52 and 53 for meshing with the drive gear 49 on the main shaft 45. This driven gear 54 is secured at the upper and lower ends thereof to said pump shafts 52 and 53 by screws 55 and connected to said pump shafts 52 and 53 by connecting pins 56 for rotation in unison therewith. Thus, with rotation of the main shaft 45, the pump shafts 52 and 53 of the oil pumps 50 and 51 are rotated simultaneously by way of the drive gear 49 and driven gear 54.

Figure 12:
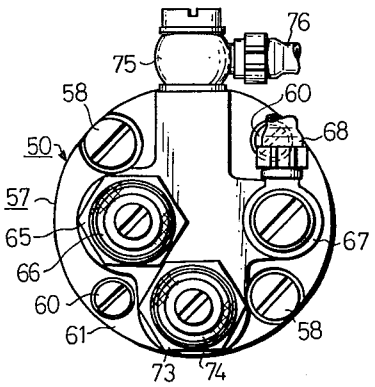
Figure 10:
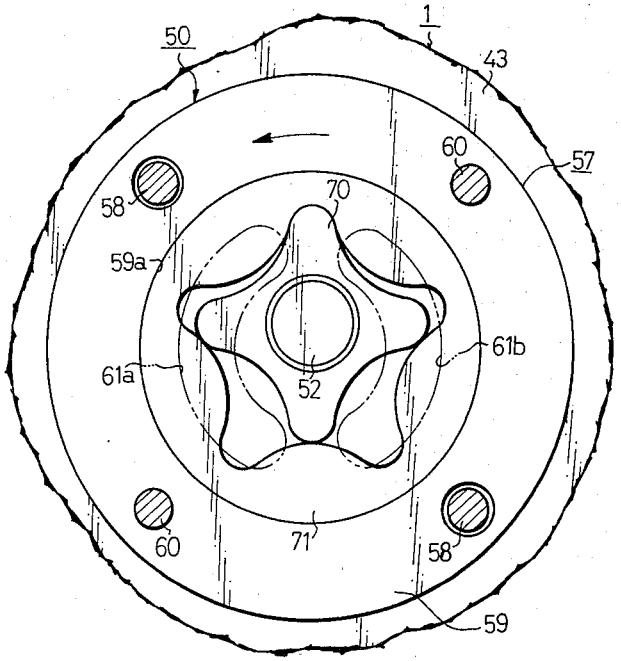
Figure 11:
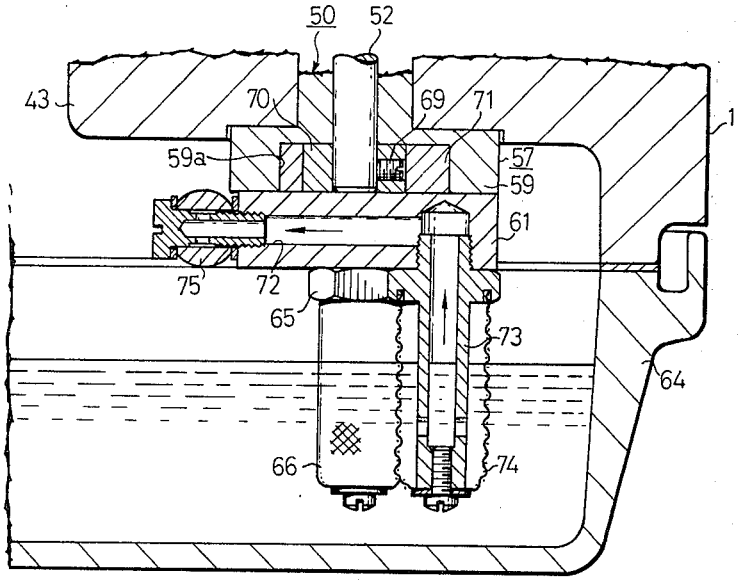

As shown in FIGS. 7, 10 and 12, a pump casing 57 of the first oil pump 50 consists of a housing 59 and a cover 61. The housing 59 is secured to the lower surface of the boss 43 within the frame 1 by two screws 58 and having a pump chamber 59*a* therein. The cover 61 is secured to the lower surface of the housing 59 by two screws 60 and having inlet and outlet arc recesses 61*a* and 61*b* on the inner surface. An inlet port 62 and an outlet port 63 are provided to the bottom portions of the recesses 61*a* and 61*b* respectively for communication with the pump chamber 59*a* of the housing 59. To the lower end of the inlet port 62, as shown in FIGS. 7 and 8, an inlet cylindrical shaft 65 is mounted for extending into an oil reservoir 64 disposed to the lower portion of the frame 1, and a mesh filter 66 is provided to the periphery portion of the shaft 65. A delivery pipe 68 is connected to the lower end of the outlet port 63 through a pipe connector 67 so that oil may be delivered to respective moving parts of the machine through the delivery pipe 68.

As shown in FIGS. 7 and 10, an inner rotor 70 is fixedly mounted by a screw 69 to the lower end of the pump shaft 52 within the pump chamber 59*a* of the housing 59, while an outer rotor 71 is rotatably housed within said pump chamber 59*a* so as to mesh with the inner rotor 70. Thus, upon rotation of the main shaft 45 and resulting rotation of the pump shaft 52 through the drive gear 49 and the driven gear 54, the inner rotor 70 and the outer rotor 71 are rotated counterclockwise in FIG. 10, and the oil is drawn into the pump chamber 59*a* from the oil reservoir 64 through the shaft 65 and the inlet port 62 so as to be supplied into the respective moving parts of the sewing machine through the outlet port 63 and the delivery pipe 68.

As shown in FIGS. 7, 8, 11 and 12, the cover 61 is provided with an oil passage 72 extending in the fore and aft direction intermediate the inlet port 62 and outlet port 63 with one end of the oil passage 72 opening downwards and the other end thereof opening rearwards. To the one opening end of the oil passage 72, there is mounted an inlet cylindrical shaft 73 extending into said oil reservoir 64 and having a mesh filter 74 on the periphery thereof. To the other opening end of the oil passage 72, there is connected an introducing pipe 76 through a pipe connector 75 so that oil may be introduced into said second oil pump 51 through the introducing pipe 76.

As shown in FIGS. 5 and 7, a pump casing 77 of the second oil pump 51 consists of a housing 79 and a cover 81. The housing 79 is secured to the upper surface of the boss 43 within the frame 1 by two screws 78 and having a pump chamber 79*a* therein. The cover 81 is secured to the upper surface of the housing 79 by two screws 80 and having inlet and outlet arc recesses 81*a*, 81*b* on the inner surface, being in much the same manner as that the pump casing 57 of the first oil pump 50 is designed. An inlet port 82 and an outlet port 83 are provided to the top portions of the recesses 81*a* and 81*b*, respectively, for communicating with the pump chamber 79*a* of the housing 79. As shown in FIGS. 7 and 8, to the upper end of the inlet port 82, the introducing pipe 76, extending from the oil passage 72 of the first oil pump 50, is connected through a pipe connector 87.

For this second oil pump 51, an inner rotor 90 is secured by a screw 89 to the upper end of the pump shaft 53 within the pump chamber 79*a* of the housing 79, while an outer rotor 91 is housed within said pump chamber 79*a* for rotation so as to mesh with said inner rotor 90, as in the case of the first oil pump 50. Upon rotation of the main shaft 45 and resulting rotation of the pump shaft 53 through the drive gear 49 and the driven gear 54, the rotors 90 and 91 are rotated in the same direction, and the oil in oil reservoir 64 is drawn into the pump chamber 79*a* through the shaft 73, the oil passage 72 and the introducing pipe 76 arranged on the first oil pump 50 and through the inlet port 82 of the second oil pump 51 so as to be delivered at the outlet port 83 under a pressure corresponding to the prevailing rotational speed of the main shaft 45.

As shown in FIGS. 5 to 8, an oil cylinder 92 is mounted on the upper surface of and as one with the second oil pump 51 and actuated in response to the oil pressure from the outlet port 83 of the second oil pump 51 for causing the shaft 26 to rotate through the operating lever 28 to change the downward pressure exerted to the presser foot 14. A cylindrical chamber 93 of the oil cylinder 92 is formed integrally with the upper surface of the cover 81 of the pump casing 77 and upwardly extended coaxially and in communication with the outlet port 83. As shown in FIGS. 7 and 8, a piston 94 is received in the cylindrical chamber 93 for vertical movement and engaged at the upper end with said operating lever 28. Thus, the piston 94 is upwardly moved in response to oil pressure from outlet port 83 and, when the rotational speed of the main shaft 45 has increased beyond a predetermined value, the downward pressure exerted to the presser foot 14 is increased correspondingly.

The first embodiment of the sewing machine, so far shown and described, operates as follows.

During a standstill of the sewing machine, the presser foot 14 is lowered onto the work supporting surface 2, as shown in FIG. 1, with the first and second oil pumps 50 and 51 shown in FIGS. 7 and 8 being at a halt. In this state, the presser foot 14 is lifted by foot actuation of the lifting pedal (not shown). The work is then laid on the work supporting surface 2 and the presser foot 14 is again lowered. At this time, the downward pressure of the pressure imparting spring 19 as preset by the adjusting knob 18 is imparted to the presser foot 14, and the work being thus held positively and without any deviation between the presser foot 14 and the work supporting surface 2.

With the work thus set, the foot pedal connected to the motor having clutch means is actuated for driving the main shaft 45 into rotation. With rotation of the main shaft 45, feed dogs 4 and 5 are actuated for feeding the work in cooperation with the presser foot 14. The needle 7 and the looper machanism (not shown) are also actuated for starting the stitching operation. As apparent from FIGS. 6 through 8, the pump shafts 52 and 53 of the oil pumps 50 and 51 are rotated concurrently with each other in accordance with the rotation of the main shaft 45 through the drive and the driven gears 49 and 54. Thus the oil is supplied to the respective moving parts from the first oil pump 50 and the piston 94 of the oil cylinder 92 is raised under the pressure of oil discharged from the second oil pump 51.

Figure 13:
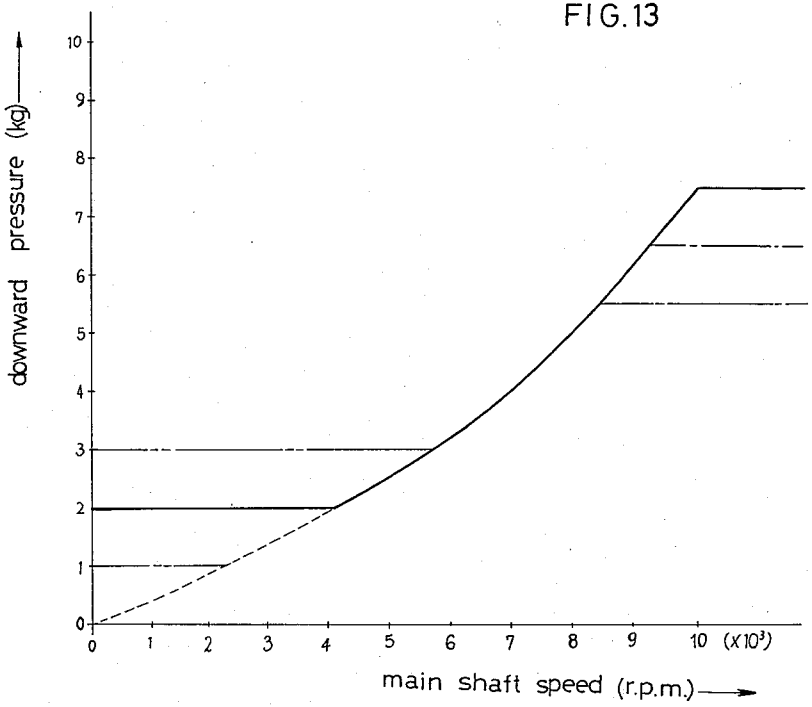
Figure 6:
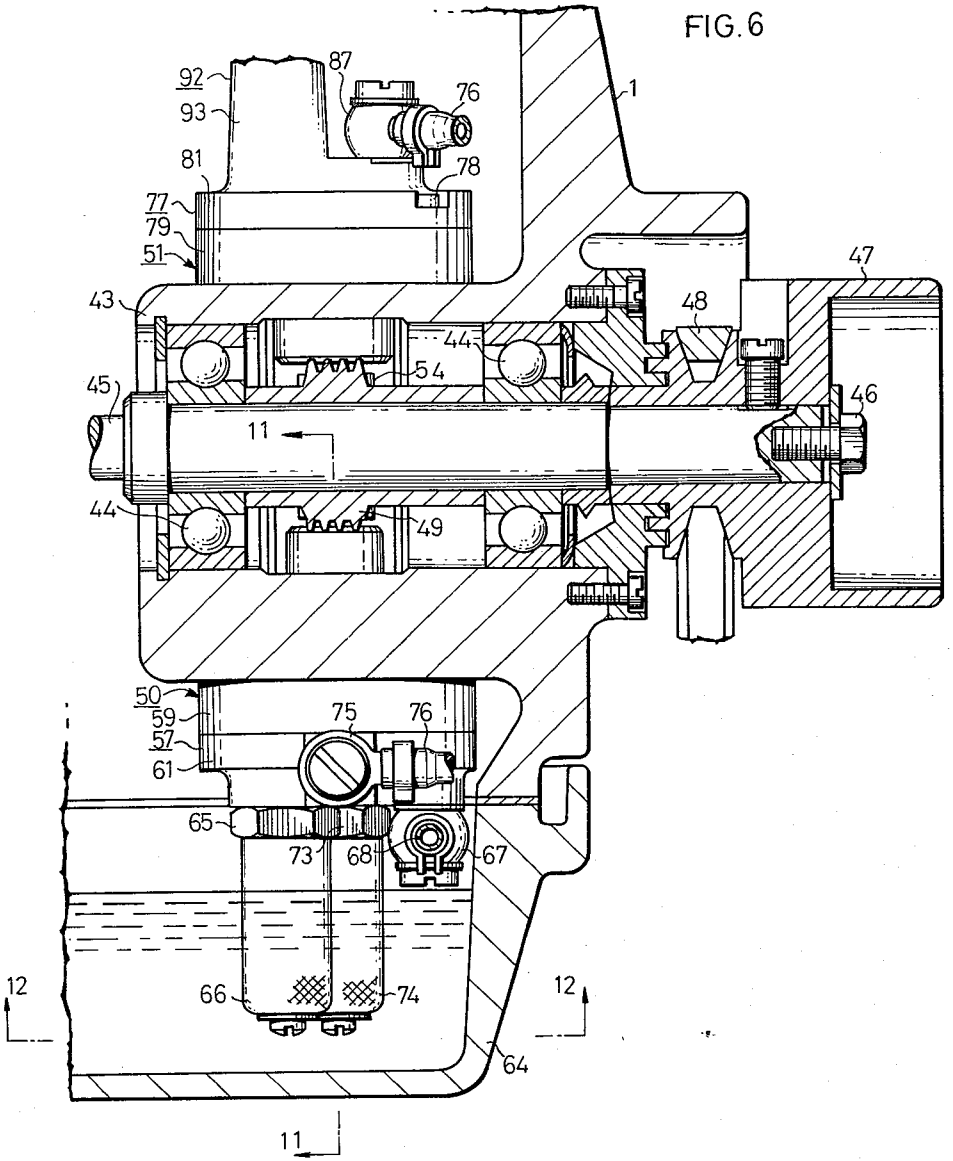

However, immediately after the start of stitching operation by the sewing machine, due to the still lower speed of rotation of the main shaft 45, the piston 94 of the oil cylinder 92 is not remarkably raised and only the motion transmitting spring 42 is compressed by the upward travel of the piston 94 through the medium of the operating lever 28, the rotary shaft 26 and the rotary lever 30, without the downward pressure being imparted from the oil cylinder 92 to the presser foot 14. Thus, as shown in FIG. 13, until the main shaft 45 has attained a predetermined rotational speed, a constant downward pressure is supplied from the spring 19 to the presser foot 14, in the same way as when the machine is at a standstill as described above, and the work may be transferred accurately without deviation through cooperation between the presser foot 14 and the feed dogs 4 and 5. This downward pressure of the spring 19 prevailing immediately after start of stitching operation may be adjusted as desired by manipulation of the adjusting knob 18 as indicated by the double dotted line in FIG. 13, depending on the thickness and/or quality of the work. For instance, such pressure may be increased for a thicker work and reduced otherwise.

After start of stitching, when the rotational speed of the main shaft 45 has increased beyond a predetermined value, the oil discharge pressure from the second pump 51 is increased correspondingly thus causing the piston 94 of the oil cylinder 92 to be raised considerably. Thus, the downward pressure is applied on the presser bar 17 through the operating lever 28, the rotary shaft, the rotary lever 30, the motion transmitting spring 42, the lever 39 and the pressure imparting lever 41, resulting in cumulative application to the presser foot 14 of the downward pressure exerted by the spring 19 and the downward pressure exerted by the oil cylinder 92. Thus, during operation of the sewing machine, as shown in FIG. 13, the downward pressure of the presser foot 14 is increased in accordance with the increase in the rotational speed of the main shaft 45 and the optimum work feed may be realized at all times without the risk of the presser foot 14 floating due to high speed operation of the feed dogs 4 and 5.

Should the rotational speed of the main shaft 45 be lowered during stitching operation through changes in the magnitude of actuation of the foot pedal, the oil discharge pressure at the second oil pump 51 is reduced correspondingly, thus the piston 94 of the oil cylinder 92 being lowered to reduce the downward pressure to be imparted to the presser foot 14. When the rotational speed of the main shaft 45 has lowered to below the predetermined value, the constant downward pressure is applied from the pressure imparting spring 19 to the presser foot 14 as immediately after start of stitching operation.

On the other hand, when the main shaft 45 has attained a predetermined high speed, the upper arm portion of the rotary lever 30 shown in FIGS. 1 and 4 engages the upper limiting screw 31 to inhibit further swinging of the rotary lever 30. Thus, even when the main shaft 45 has attained a high speed in excess of a predetermined value, the downward pressure exerted to the presser foot 14 is not increased correspondingly but is maintained at a constant value. The upper limit of the downward pressure during this high speed operation may be changed as desired by adjusting the degree of protuberance of the screw 31 relative to the lever 30 through manipulation of the screw 31, as indicated by the dotted chain line in FIG. 13, depending on the thickness and/or quality of the work. Thus, the downward pressure may for instance be lowered for a work of reduced thickness.

It is to be noted that, in the present embodiment, since the oil drawn into the suction side of the pump chamber **79*a* from the inlet port 82 of the second oil pump 51 with rotation of the pump shaft 53 may not be discharged out of the discharge side, the oil at the discharge side of the pump chamber 79*a* is displaced towards the suction side through a gap between the inner and outer rotors 90 and 91 as well as a gap between the rotors 90 and 91 and the housing 79, no hindrance may be caused in the pump operation. Thus, for this second oil pump 51, an oil pressure proportionate to the rotational speed of the pump shaft 53 which is operatively connected to the main shaft 45 will act on the piston 94 of the oil cylinder 92**.

Reference is made to FIGS. 14 to 28 for illustration of the second embodiment of the present invention as applied to an over edge sewing machine.

Figure 14:
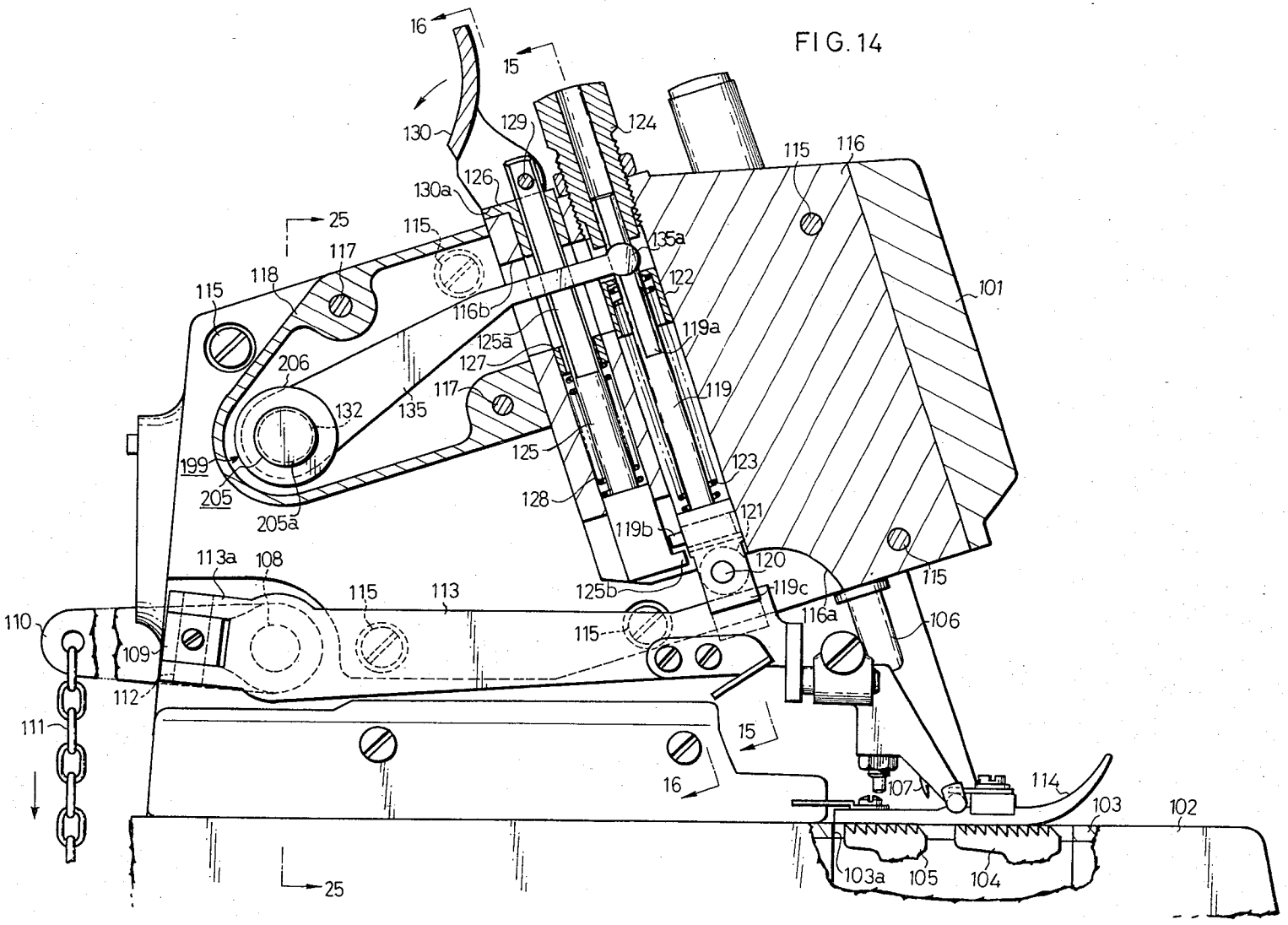
Figure 17:
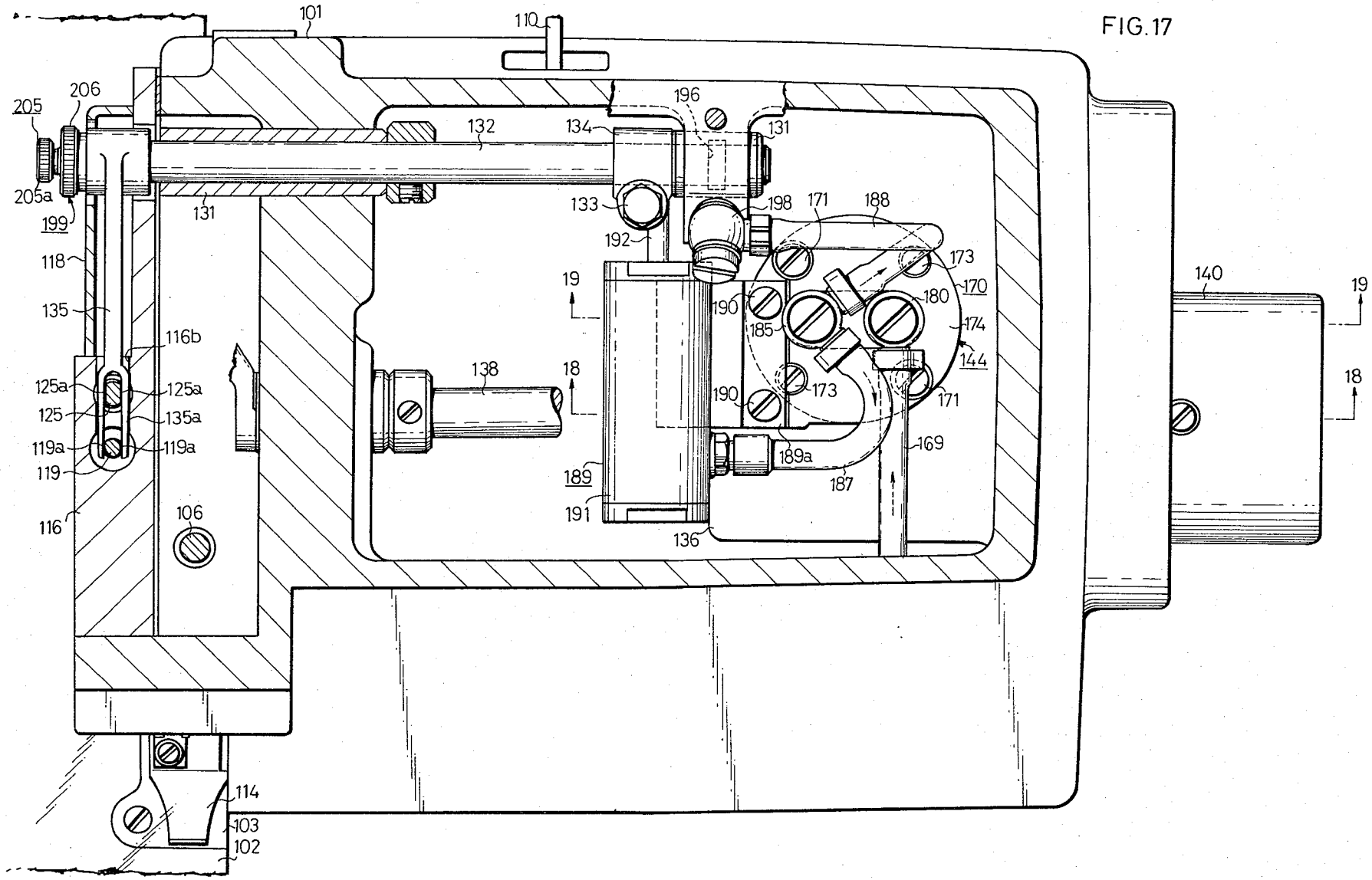

As shown in FIGS. 14 and 17, a throat plate 103 is mounted to the upper surface of the lower portion of a frame 101 and are designed to provide a work supporting surface 102 in cooperation with the frame 101. Said throat plate 103 having a needle aperture (not shown) and a slot **103*a* for the passage of feed dog means. A main feed dog 104 and an auxiliary feed dog 105 are disposed within the frame 101 below said throat plate 103 and are designed to perform a four-stage feed motion so as to emerge from and exit into slot 103*a* on the plate 103 to effect the feed of the work supported on the surface 102. Above said throat plate 103, a needle bar 106 is mounted for vertical travel within a head portion of the frame 101, and a needle 107, mounted to the lower end of the needle bar 106, is designed to form over edge stitches on the work in cooperation with a looper mechanism (not shown) mounted within the frame 101 below the throat plate 103**.

As shown in FIG. 14, at the back of the frame 101, a rotary shaft 108 is mounted for rotation about a horizontal axis, and fixedly mounts at one end a rotary arm 109. A presser lifting lever 110 is secured to the other end of the rotary shaft 108, being connected by chain 111 to a lifting pedal (not shown). A supporting arm 113 is mounted to said rotary arm 109 at a rear bifurcate portion **113*a* by a pin 112 for transverse rotation. A presser foot 114 is mounted to the front portion of the arm 113 to effect the feed of the work on the surface 102 through cooperation with said feed dogs 104 and 105. With the above construction, upon the downward actuation of said lifting pedal, said supporting arm 113 is rotated counterclockwise from the position of FIG. 14, by way of the chain 111, the rotary shaft 108 and the rotary arm 109, and the presser foot 114 is lifted away from the work supporting surface 102. Upon rotation of the supporting arm 113 sidewise about the pin 112, the presser foot 114 is receded sidewise away from the position corresponding to said feed dogs 104 and 105**.

As shown in FIGS. 14 through 17, a cover plate 116 is secured to the left hand side of the head portion of the frame 101 by plural screws 115. A recess **116*a* opening downwards and backwards is provided at the lower end of the forward portion of the cover plate 116 while a slot 116*b* is provided at the upper end of the rear surface of said forward portion. To the left hand side of the rear portion of the cover plate 116, an auxiliary cover plate 118 is mounted with two screws 117, and has its inside communicating with said slot 116*b***.

A presser bar 119 mounted through the foremost portion of the cover plate 116 so as to be movable vertically therethrough has cutout surfaces **119*a* on both upper sides, a protuberant engaging portion 119*b* on the lower rear surface and a bifurcate portion 119*c* at the lower end. A roller 121 is rotatably mounted by a pin 120 within the bifurcate portion 119*c* of the presser bar 119 for engaging with the upper forward portion of the supporting arm 113. A cap-like washer 122 is fittedly received onto the upper end of the presser bar 119 so as to be vertically movable within said cutout surfaces 119*a* of the presser bar 119. A pressure imparting spring 123 is interposed between the washer 122 and the lower portion of the presser bar 119 for imparting a downward pressure to the presser foot 114 through the presser bar 119 and the supporting arm 113. A manual adjusting knob 124 is rotatably screwed onto the upper end of the cover plate 116 so as to fit into the upper end of the presser bar 119. Thus, upon rotative manipulation of this adjusting knob 124, the spring pressure of the pressure imparting spring 123 may be modified for suitably setting the downward pressure exerted to the presser foot 114**.

At the back of the presser bar 119, a pressure releasing bar 125 is mounted, for the vertical movement, through the forward portion of the cover plate 116 and has cutout surfaces **125*a* on both upper sides as well as an engaging projection 125*b* on the lower front surface, said projection 125*b* being adapted to engage said engaging portion 119*b* of the presser bar 119 from below. Substantially tubular washers 126 and 127 are fitted to said releasing bar 125 and secured at the upper and central portions of the cover plate 116. A compression spring 128 is interposed between the central washer 127 and the lower portion of the bar 125 for urging said bar 125 downwards. A pressure releasing lever 130 is rotatably mounted to the upper end of the bar 125 by a pin 129. With the above construction, said bar 125 being raised by operation of a lower cam portion 130*a* upon counterclockwise rotation of the releasing lever 130 from the position of FIG. 14, the presser bar 119 being thus raised to release the downward pressure so far exerted on the presser foot 114**.

Figure 16:
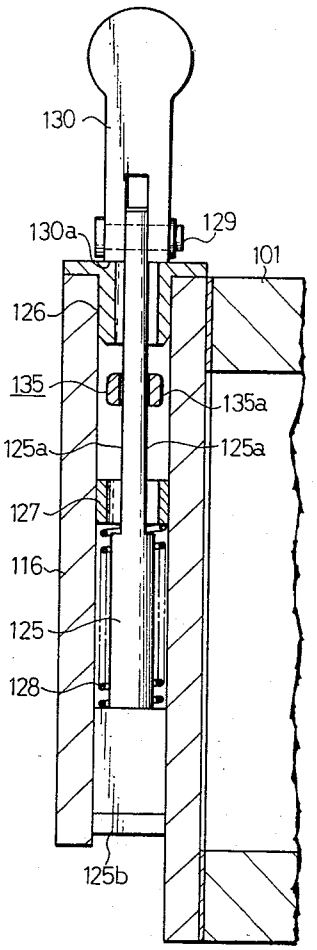
Figure 15:
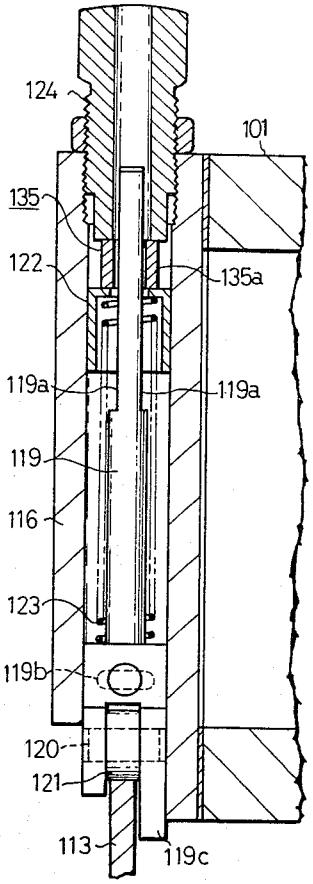

As shown in FIGS. 14, 17, 25 and 26, in the upper rear portion of the frame 101, a cylindrical rotary shaft 132 is mounted by a pair of bearings 131 for rotation about a horizontal axis. An operating lever 134 is secured by bolt 133 to the right hand extremity (left hand extremity only in FIG. 25) of the shaft 132 for extending downwards, while a pressure imparting lever 135 is mounted integrally at the base end to the left hand extremity (right hand extremity in FIG. 25) of the rotary shaft 132 within auxiliary cover 118. As shown in FIGS. 14 to 16, the bifurcate portion 135*a* of the lever 135 invades into the inside of the cover plate 116 through the slot 116*b* to engage the upper surface of the washer 122 on the presser bar 119, as it holds the cutout surfaces 125*a*, 119*a* on both sides of the releasing bar 125 and the presser bar 119. With the above construction, on the clockwise rotation of the rotary shaft 132 in FIG. 14, the pressure imparting lever 135 is turned in the same direction so that the downward pressure is applied to the presser foot 114 depending on the amount of rotation of the rotary shaft 132 in addition to the downward pressure applied by the pressure imparting spring 114.

In the present embodiment, the amount of rotation of the rotary shaft 132 is determined in response to the rotational speed of a main shaft for changing the downward pressure of the presser foot 114. A boss 136 is provided on the right hand inner surface of the frame 101, and the main shaft 138 is mounted through the boss 136 within the frame 101 by plural bearings 137 for rotation about a horizontal axis. A pulley 140 is secured by a bolt 139 to the right hand extremity of the main shaft 138, and a belt 141 is placed between the pulley 140 and an electric motor (not shown) having clutch means. In the above construction, upon actuation of a foot pedal (not shown) connected to said electric motor, and resulting connection of the clutch means, the main shaft 138 is rotated by way of the belt 141 and the pulley 140 clockwise in FIG. 20 for driving the respective moving parts of the sewing machine including said feed dogs 104, 105 and needle bar 106. Within the boss 136 of the frame 101, a helical drive gear 142 is fitted securely on the main shaft 138 for rotation in unison with the main shaft 138.

A first oil pump 143 and a second oil pump 144, both of which are trochoid pumps, are mounted to the upper and lower surfaces respectively of the boss 136 inside the frame 101, with pump shafts 145 and 146 extending towards the interior of the boss 136 at back of the main shaft 138 and their axes being coincident and arranged vertically. A helical driven gear 147 is mounted between the foremost parts of the pump shafts 145 and 146 for meshing with the drive gear 142 on the main shaft 138. This driven gear 147 is secured at the upper and lower ends thereof to said pump shafts 145 and 146 by screws 148 and connected to said pump shafts 145 and 146 by connecting pins 149 for rotation in unison therewith. Thus, with rotation of the main shaft 138, the pump shafts 145 and 146 of the oil pumps 143 and 144 are rotated simultaneously by way of the drive gear 142 and driven gear 147.

Figure 19:
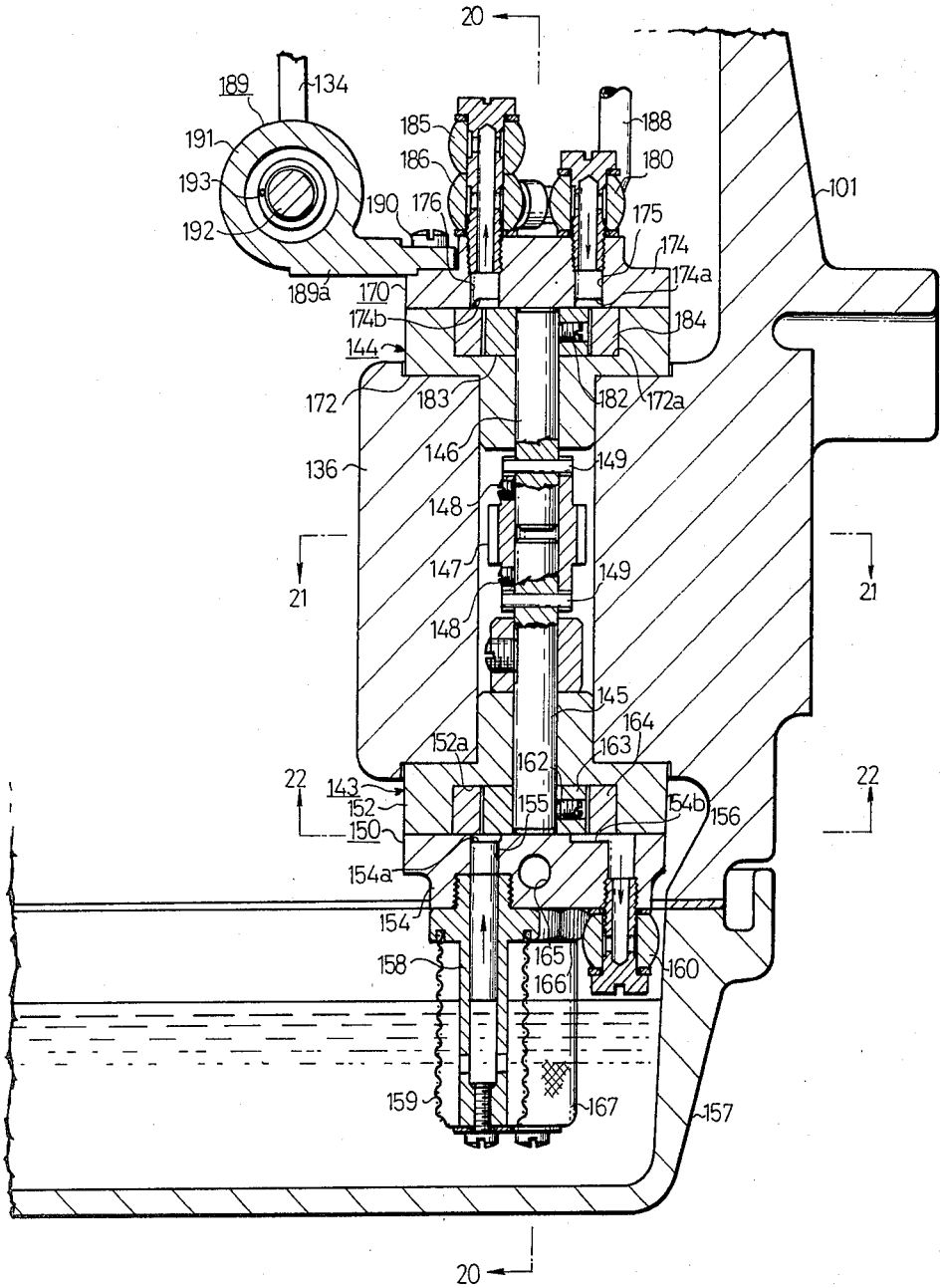
Figure 22:
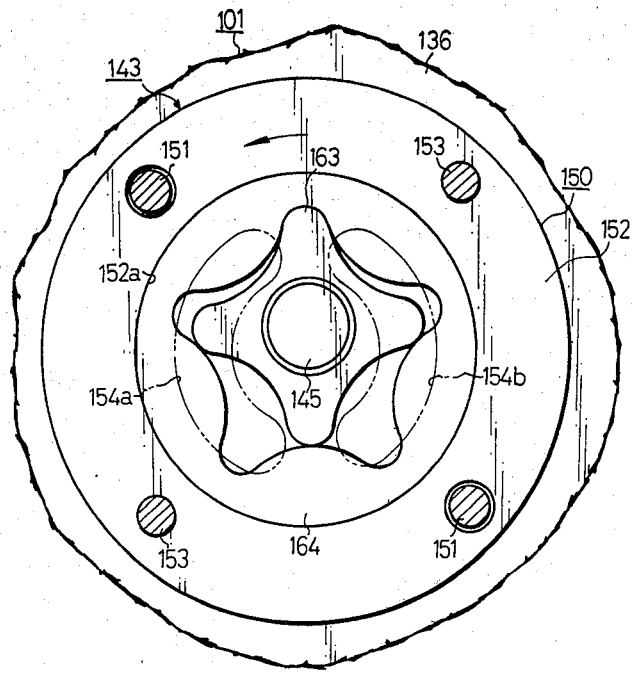
Figure 23:
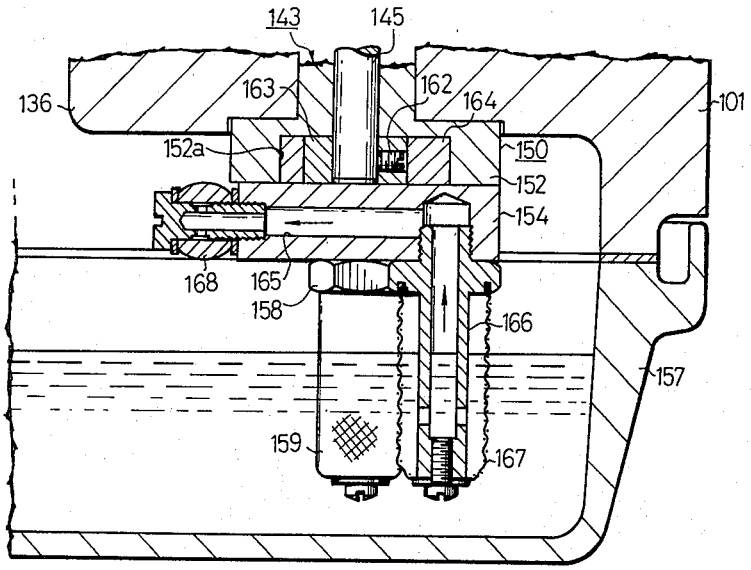
Figure 24:
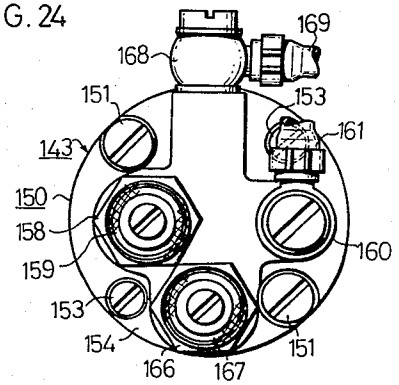

As shown in FIGS. 19, 22 and 24, a pump casing 150 of the first oil pump 143 consists of a housing 152 and a cover 154. The housing 152 is secured to the lower surface of the boss 136 within the frame 101 by two screws 151 and having a pump chamber 152*a* therein. The cover 154 is secured to the lower surface of the housing 152 by two screws 153 and having inlet and outlet arc recesses 154*a* and 154*b* on the inner surface.

Figure 20:
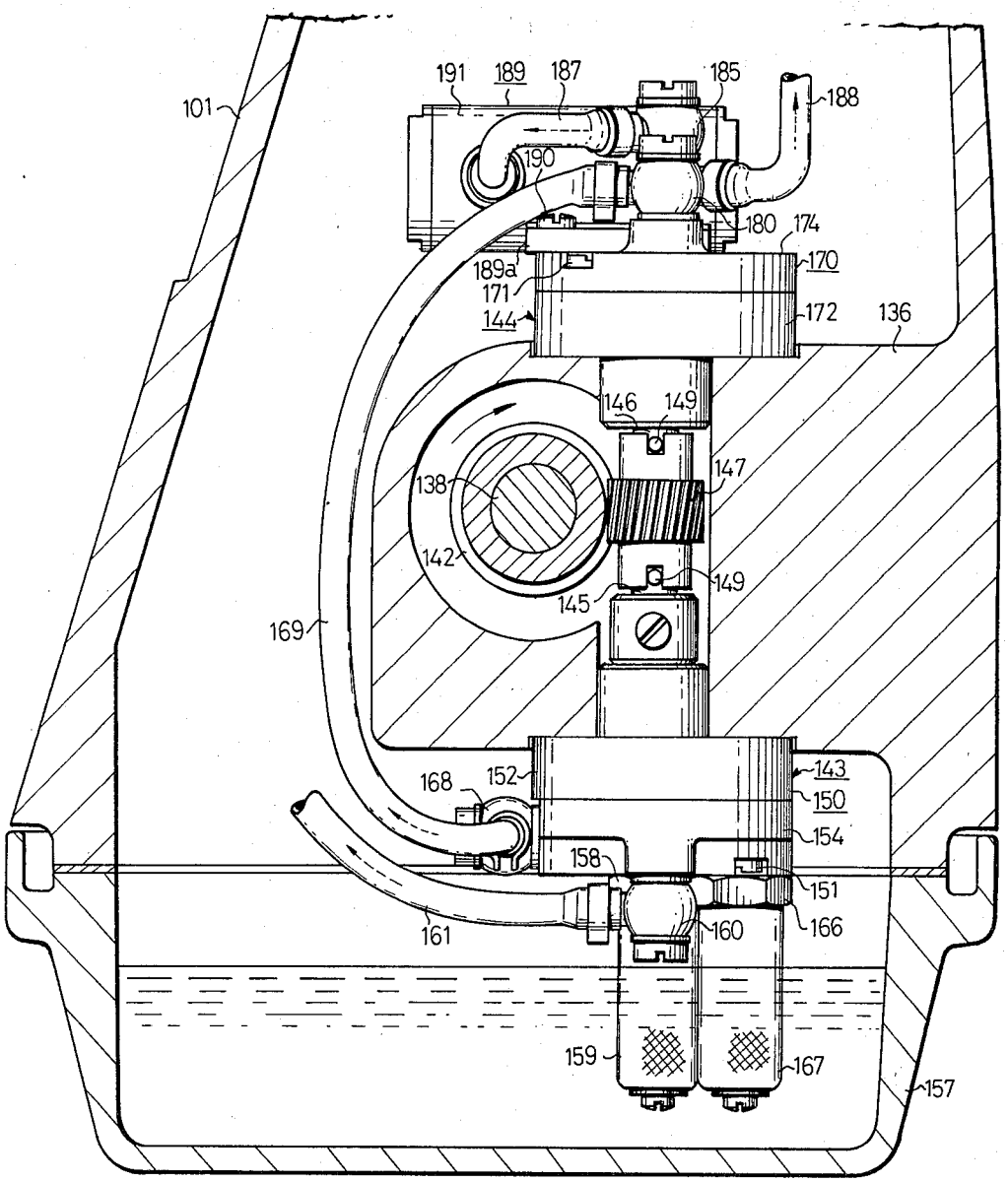
Figure 21:
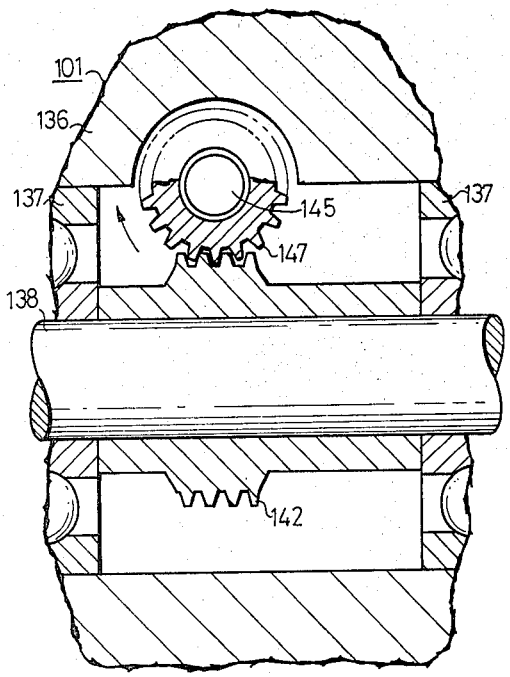

An inlet port 155 and an outlet port 156 are provided to the bottom portions of the recesses 154*a* and 154*b* respectively for communication with the pump chamber 152*a* of the housing 152. To the lower end of the inlet port 155, as shown in FIGS. 19 and 20, an inlet cylindrical shaft 158 is mounted for extending into an oil reservoir 157 disposed to the lower portion of the frame 101, and a mesh filter 159 is provided to the peripheral portion of the shaft 158. A delivery pipe 161 is connected to the lower end of the outlet port 156 through a pipe connector 160 so that oil may be delivered to respective moving parts of the machine through said delivery pipe 161.

As shown in FIGS. 19 and 22, an inner rotor 163 is fixedly mounted by a screw 162 to the lower end of the pump shaft 145 within the pump chamber 152*a* of the housing 152, while an outer rotor 164 is rotatably housed within said pump chamber 152*a* so as to mesh with the inner rotor 163. Thus, upon rotation of the main shaft 138 and resulting rotation of the pump shaft 145 through the drive gear 142 and the driven gear 147, the inner rotor 163 and the outer rotor 164 are rotated counterclockwise in FIG. 22, and the oil is drawn into the pump chamber 152*a* from the oil reservoir 157 through the shaft 158 and the inlet port 155 so as to be supplied into the respective moving parts of the sewing machine through the outlet port 156 and the delivery pipe 161.

As shown in FIGS. 19, 20, 23 and 24, the cover 154 is provided with an oil passage 165 extending in the fore and aft direction intermediate the inlet port 155 and the outlet port 156 with one end of the oil passage 165 opening downwards and the other end thereof opening rearwards. To the one opening end of the oil passage 165, there is mounted an inlet cylindrical shaft 166 extending into said oil reservoir 157 and having a mesh filter 167 on the periphery thereof. To the other opening end of the oil passage 165, there is connected an introducing pipe 169 through a pipe connector 168 so that oil may be introduced into said second oil pump 144 through the introducing pipe 169.

Figure 18:
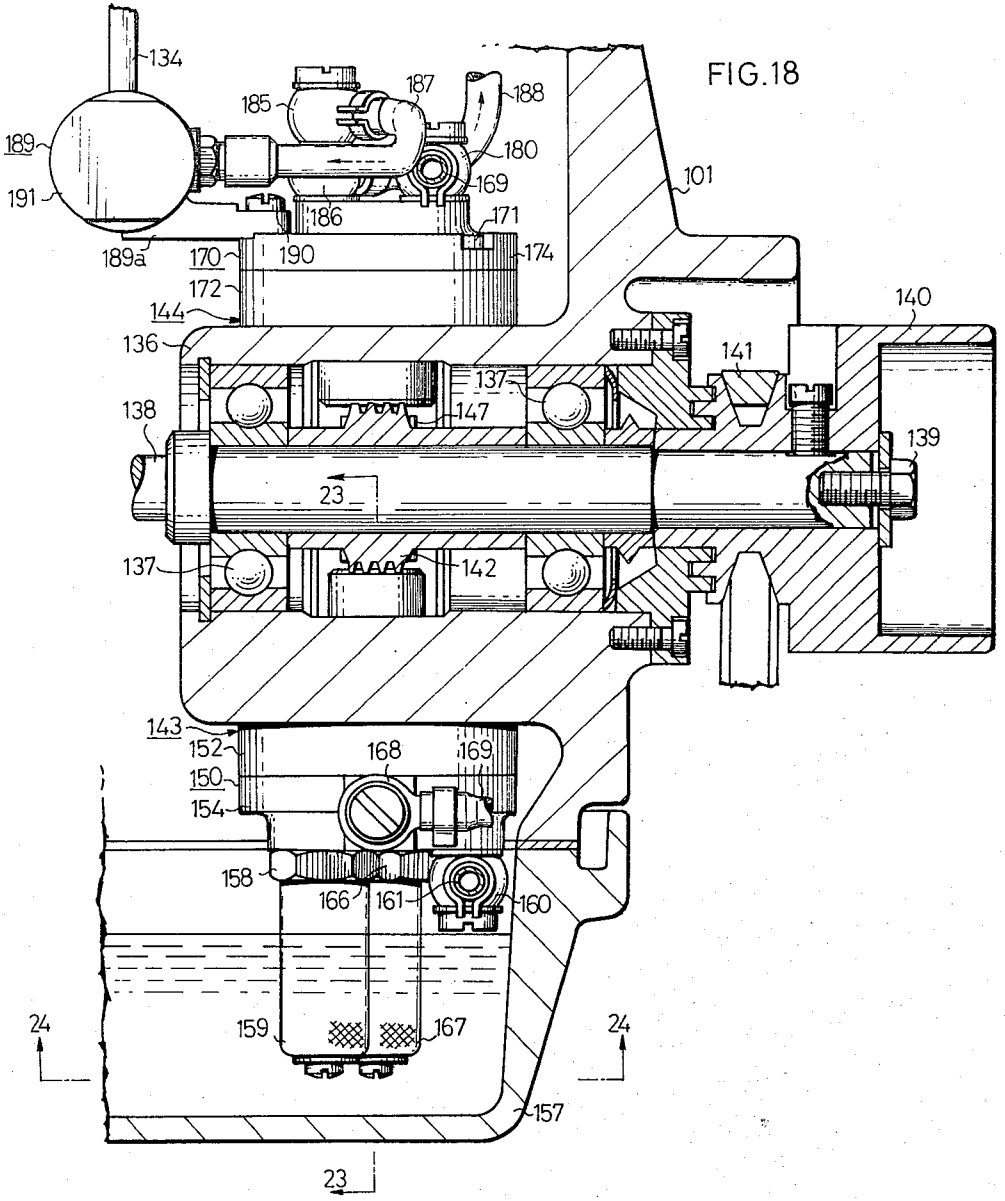

As shown in FIGS. 17 and 19, a pump casing 170 of the second oil pump 144 consists of a housing 172 and a cover 174. The housing 172 is secured to the upper surface of the boss 136 within the frame 101 by two screws 171 and having a pump chamber 172*a* therein. The cover 174 is secured to the upper surface of the housing 172 by two screws 173 and having inlet and outlet circular recesses 174*a*, 174*b* on the inner surface, being in much the same manner as that the pump casing 150 of the first pump 143 is designed. An inlet port 175 and an outlet port 176 are provided to the top portions of the recesses 174*a* and 174*b*, respectively, for communicating with the pump chamber 172*a* of the housing 172. As shown in FIGS. 18 to 20, to the upper end of the inlet port 175, the introducing pipe 169, extending from the oil passage 165 of the first oil pump 143, is connected through a pipe connector 180.

For the second oil pump 144, an inner rotor 183 is secured by a screws 182 to the upper end of the pump shaft 146 within the pump chamber 172*a* of the housing 172, while an outer rotor 184 is housed within said pump chamber 172*a* for rotation so as to mesh with said inner rotor 183, as in the case of the first oil pump 143. Upon rotation of main shaft 138 and resulting rotation of the pump shaft 146 through the drive gear 142 and the driven gear 147, the rotors 183 and 184 are rotated in the same direction, and the oil in the oil reservoir 157 is drawn into the pump chamber 172*a* through the inlet cylindrical shaft 166, the oil passage 165 and the introducing pipe 169 arranged on the first oil pump 143 and through the inner port 175 of the second oil pump 144 so as to be delivered at the outlet port 176 under a pressure corresponding to the prevailing rotational speed of the main shaft 138.

Figure 25:
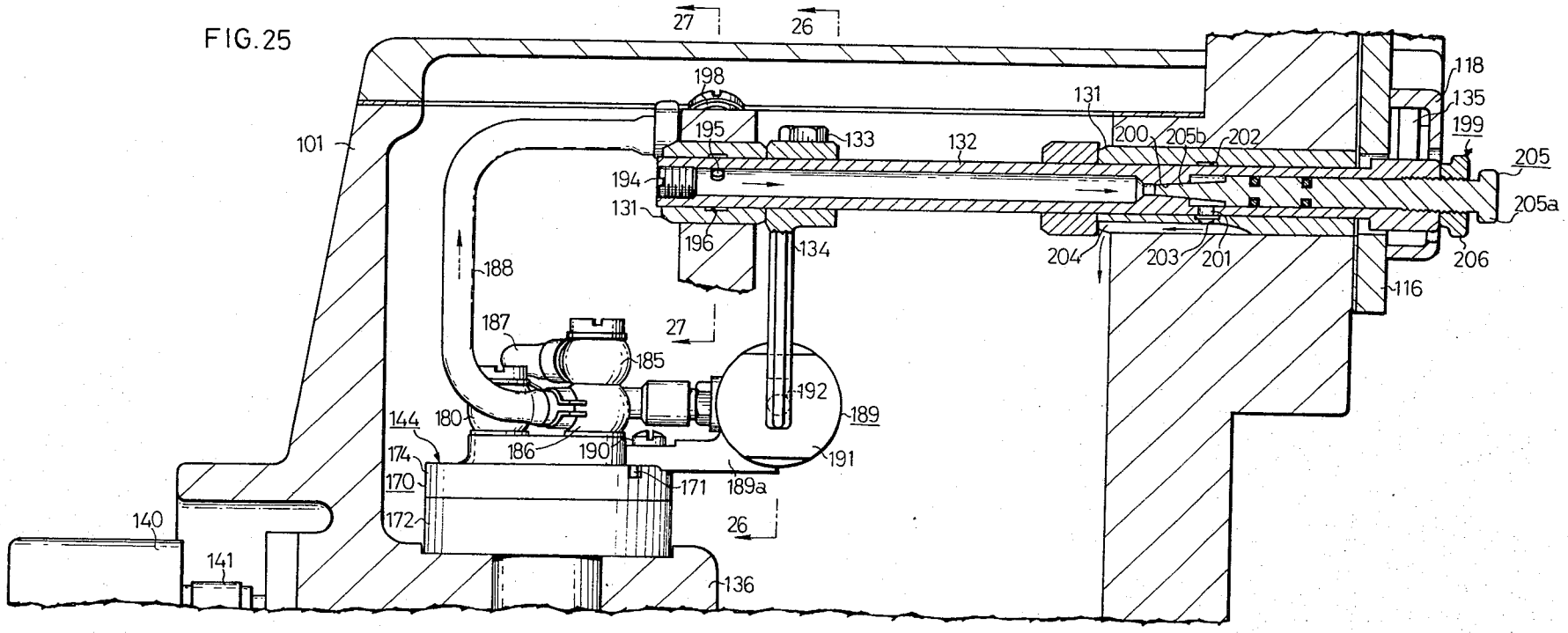
Figure 27:
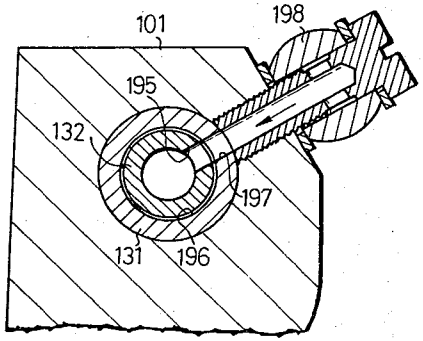
Figure 26:
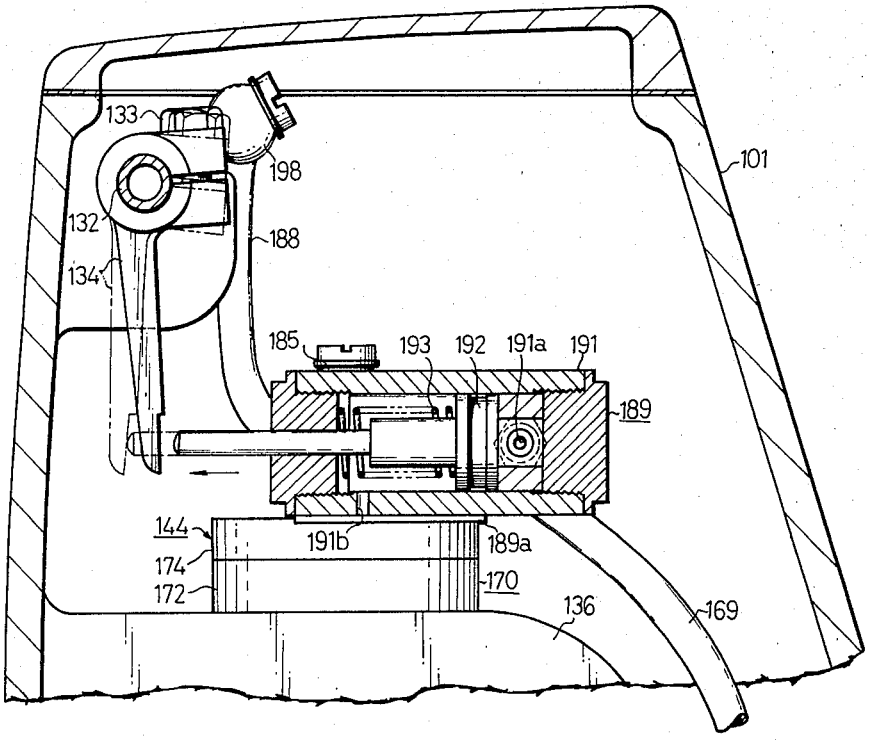

As shown in FIGS. 17, 18, 19, 20 and 25, an oil pressure imparting pipe 187 and a diverging pipe 188 are connected to the outlet port 176 of the second oil pump 144 through pipe connectors 185 and 186. To the upper surface of the cover 174 of the second oil pump 144, an oil cylinder 189 is fastened at a leg 189*a* by two screws 190 for extending in the fore and aft direction above and laterally of the second pump 144. An oil inlet port 191*a* and an oil outlet port 191*b* are provided on the peripheral surface of a cylindrical chamber 191, as shown in FIG. 26, and the oil pressure imparting pipe 187 extending from the outlet port 176 of the second oil pump 144 is connected to the oil inlet port 191*a*. As shown in FIGS. 25 and 26, a piston 192 is slidably mounted in the chamber 191 of the oil cylinder 189 and engaged at the rear end with the operating lever 134 on said rotary shaft 132. A return spring 193 is interposed between said piston 192 and the chamber 191 for urging said piston 192 towards start position shown by solid line in FIG. 26 to maintain said piston 192 spaced apart from the operating lever 134 suitably positioned in advance through adjustment of the adjusting knob 124. Thus, the piston 192 of the oil cylinder 189 is receded in response to the oil discharge pressure prevailing at the outlet port 176 of the second oil pump 144, so that, when the rotational speed of the main shaft 138 has increased beyond a predetermined value, the downward pressure to be exerted to the presser foot 114 is increased correspondingly.

As shown in FIGS. 17, 25, 26 and 27, a stop-up screw 194 is mounted to the inner end of the cylindrical rotary shaft 132 and an oil inlet port 195 is provided on the peripheral surface near said inner end. A groove 196 is formed on the inner periphery surface of the bearing 131 carrying the shaft 132 at an extremity thereof corresponding to the oil inlet port 195, while an oil inlet port 197 is provided at the bearing 131 and the frame 101 for communication with the groove 196. The diverging pipe 188 extending from the outlet port 176 of the second oil pump 144 is connected by way of a pipe connector 198 to the oil inlet port 197, and the oil discharged from the port 176 may be introduced into the inside of the rotary shaft 132 through the diverging pipe 188, the port 197, the groove 196 and the port 195.

As shown in FIGS. 17 and 25, a manually operable control valve 199, designed to adjust the pressure of oil which is discharged from the second oil pump 144 to act on the oil cylinder 189, is mounted to the outer extremity of said rotary shaft 132. The ratio of the change of the oil pressure generated by the second oil pump 144 under the rotational speed of the main shaft 138 to the change of the downward pressure to the foot presser 114 responsive to such change of oil pressure may be varied by adjustment of the control valve 199.

Thus, a tapered hole 200 increasing its diameter gradually towards outside, is provided to the inner peripheral surface of the shaft 132 near the outer extremity thereof, while an oil outlet port 201 is provided to the rotary shaft 132 near the outer extremity of the tapered hole 200. A groove 202 is provided to the inner peripheral surface of the other bearing 131 carrying the rotary shaft 132 at the side of the oil outlet port 201, while an oil outlet port 203 and an oil exhausting groove 204 are provided to the bearing 131 for communicating with the groove 202. A valve stem 205 is threadedly mounted to the outer extremity of the rotary shaft 132. A knob 205*a* is provided on the outer extremity of said stem 205, and a corresponding tapered portion 205*b* is provided to the inner extremity of the stem 205 for contacting with or separating from the tapered hole 200 in the rotary shaft 132. A nut 206 is threadedly mounted to the volve stem 205 laterally and outwardly of the auxiliary cover plate 118 for securing the valve stem 205 at the desired adjusted position.

Figure 28:
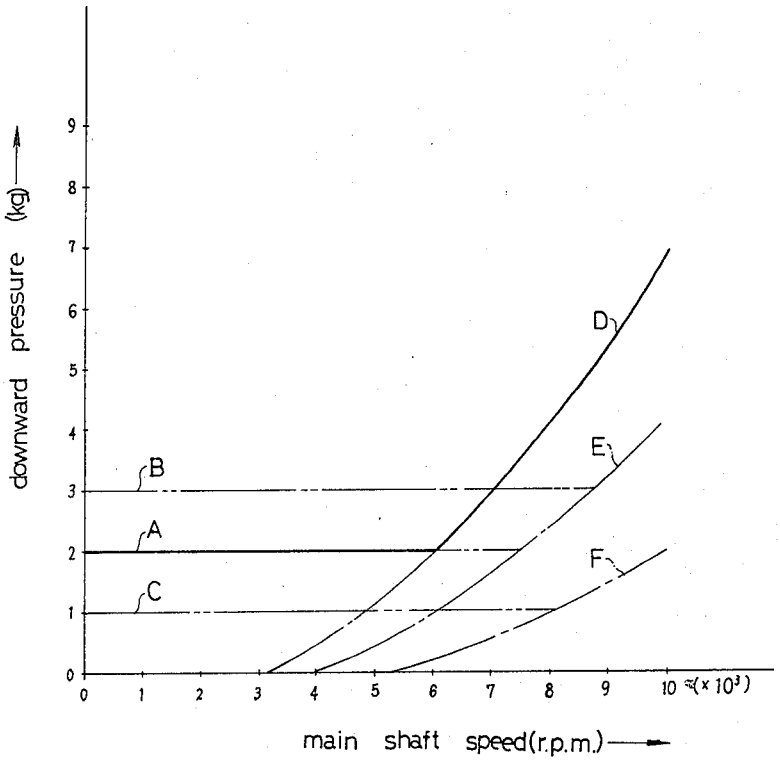

Thus, when the tapered portion 205*b* is positioned in close proximity to the tapered hole 200, based on adjustment by the knob 205, as shown in FIG. 25, the oil discharged from the second pump 144 is substantially not supplied towards the rotary shaft 132 and hence the oil pressure acting on the piston 192 of the oil cylinder 189 is elevated resulting in an increased ratio of the change in downward pressure to the change in the rotational speed of the main shaft 138, as shown by the solid line in FIG. 28. Conversely, when the tapered portion 205*b* of the valve stem 205 is separated from the tapered hole 200 in the course of adjustment, the oil discharged from the second oil pump 144 is delivered into the frame 101 through the diverging pipe 188, the rotary shaft 132, a gap between the tapered hole 200 and the tapered portion 205*b*, the oil outlet port 201, the groove 202, the oil outlet port 203 and the oil exhausting groove 204, depending on the gap width between the tapered hole 200 and the tapered portion 205*b*. Hence, the oil pressure acting on the piston 192 of the oil cylinder 189 is lowered, thus resulting in a reduced ratio of the change in the downward pressure to the change in the rotational speed of the main shaft 138.

The second embodiment of the sewing machine, so far shown and described, operates as follows.

During a standstill of the sewing machine, the presser foot 114 is lowered onto the work supporting surface 102, as shown in FIG. 14, with the first and second oil pumps 143 and 144 shown in FIGS. 19 and 20 being at a halt. Under this condition, the presser foot 114 is lifted through foot actuation of the lifting pedal (not shown). The work is then laid on the work supporting surface 102 and the presser foot 114 is again lowered. In this way, the downward pressure of the pressure imparting spring 123 as preset by the knob 124 is imparted to the presser foot 114, and the work is held positively without deviation between the presser foot 114 and the work supporting surface 102.

With the work thus set, the foot pedal connected to the motor having clutch means is actuated for driving the main shaft 138 into rotation. With rotation of the main shaft 138, feed dogs 104 and 105 are actuated for feeding the work in cooperation with the presser foot 114. The needle 107 and the looper mechanism (not shown) are also actuated for starting the stitching operation. As apparent from FIGS. 18 to 20, the pump shafts 145 and 146 of the first and second oil pumps 143 and 144 are rotated concurrently with each other in accordance with rotation of the main shaft 138 through the drive gear 142 and driven gear 147. Thus the oil discharged from the first oil pump 143 starts to be supplied into the respective moving parts of the sewing machine, at the same time that the oil discharged from the second oil pump 144 starts to be supplied into the cylindrical chamber 191 of the oil cylinder 189.

However, immediately after the start of stitching operation, since the oil discharged from the second oil pump 144 is at a reduced pressure due to the low rotational speed of the main shaft 138, the piston 192 of the oil cylinder 189 may not be displaced back markedly against the operation of the return spring 193, the piston 192 being displaced at most to the vicinity of a position where the piston 192 is engageable with the operating lever 134. Thus, until the rotational speed of the main shaft 138 has attained a predetermined value, as indicated at the solid line A in FIG. 28, the downward pressure emanating from the oil cylinder 189 is not imparted to the presser foot 114 and only the constant downward pressure emanating from the pressure imparting spring 123 is applied to the presser foot 114 as when the machine is at a standstill, the work being accurately transferred without deviation through cooperation between the presser foot 114 and the feed dogs 104 and 105. The value of the downward pressure, prevailing immediately after the start of the stitching operation, may be suitably adjusted by manipulation of the adjusting knob 124 depending on the thickness and/or quality of the work. Thus, such downward pressure may for instance be increased for the work of larger thickness as shown by double dotted chain line B, and reduced for a work of smaller thickness, as shown by chain dotted line C in FIG. 28.

When the stitching operation is started as described above and the rotational speed of the main shaft 138 has increased beyond a predetermined value, the oil discharged from the second oil pump 144 may be at a correspondingly raised pressure and the piston 192 of the oil cylinder 189 is displaced towards rear against the force of the return spring 193. Thus, a pressure is applied on the upper extremity of the pressure imparting spring 123 through the operating lever 134, the rotary shaft 132, the pressure imparting lever 135 and the washer 122, resulting in cumulative application, to the presser foot 114, of the downward pressure emanating from the spring 123 and the downward pressure emanating from the oil cylinder 189. Thus, during operation of the sewing machine, the downward pressure of the presser foot 114 is increased in accordance with the increase in the rotational speed of the main shaft 138, as shown at solid line D in FIG. 28, and the optimum work feed may be realized at all times without the risk of the presser foot 114 floating due to high speed operation of the feed dogs 104 and 105.

Should the rotational speed of the main shaft 138 be lowered during stitching operation through changes in the magnitude of actuation of the foot pedal, the oil discharge pressure at the second oil pump 144 is reduced correspondingly, thus the piston 192 of the oil cylinder 189 being returned forwardly by operation of the return spring 193 to lower the downward pressure to be imparted to the presser foot 114. When the rotational speed of the main shaft 138 has decreased to below the predetermined value, the constant downward pressure is applied from the pressure imparting spring 123 to the presser foot 114 as immediately after start of the stitching operation described above.

In addition, by adjusting the valve stem 205 of the control valve 199 shown in FIGS. 17 and 25 for suitably setting the gap width between the tapered portion **205*b* and the tapered hole 200 inside the rotary shaft 132, the amount of oil discharged from the outlet port 176 of the second oil pump 144 into the frame 101 through the inside of the rotary shaft 132 may be increased or decreased with consequent changes in the pressure of the oil supplied from the outlet port 176 of the second oil pump 144 into the oil cylinder 189. Hence, the ratio of the change in the downward pressure to the change in rotational speed of the main shaft 138 may be suitably set in dependence on the thickness and/or quality of the work for realizing an optimum work feed. Thus, the said ratio may be set to a larger value for a work of larger thickness as shown at solid line D and to smaller values for works of reduced thickness as shown at dotted chain lines E and F in FIG. 28**.

Moreover, when the downward pressure emanating from the pressure imparting spring 123 has been changed through adjustment of the manual adjusting knob 124, the operating lever 134 shown in FIG. 26 is turned through the pressure imparting lever 135 and the rotary shaft 132 shown in FIG. 14, thus the distance between the lever 134 and the foremost part of the piston 192 being changed and the piston 192 being moved rearwards with rotation of the main shaft 138 to change the distance to be traversed until the piston 192 engages with the lever 134. Hence, by changing or adjusting the downward pressure emanating from the pressure imparting spring 123, as indicated at solid line A or double dotted chain lines B, C in FIG. 28, the start point of imparting of the downward pressure of the oil cylinder 189 in response to the prevailing rotational speed of the main shaft 138 may be changed, irrespective of whether the ratio of the change in the downward pressure to the change in the rotational speed of the main shaft 138 is set as indicated at solid line D or chain dotted lines E or F in FIG. 28.

In the present embodiment, should the machine be actuated with the gap between the tapered portion **205*b* of valve stem 205 and the tapered hole 200 be closed due to adjustment setting of the control valve 199, the oil drawn from the inlet port 175 into the suction side of the pump chamber 172*a* with rotation of the pump shaft 146 is substantially not discharged from the discharge side. At this time, however, since the oil at the discharge side of the pump chamber 172*a* is displaced towards the suction side through a clearance between the inner and outer rotors 183 and 184 as well as a clearance between the two rotors 183 and 184 and the housing 172, no hindrance may be caused to operation of the second oil pump 144. Thus, in the second oil pump 144, an oil pressure proportionate to the rotational speed of the pump shaft 146 operatively connected to the main shaft 138 acts on the piston 192 of the oil cylinder 189**.

The various components of the sewing machine according to the present invention may be changed within the scope of the present invention, such as using vane pumps, plunger pumps or gear pumps in place of trochoid pumps as oil pumps used in the preferred embodiments.

What is claimed is:

1. A sewing machine comprising;

a frame defining an inner chamber therein and having a work supporting surface thereon, a presser foot for downwardly depressing a work on said work supporting surface, pressure imparting means for applying a downward pressure to said pressure foot, a main shaft rotatably supported on said frame, an oil reservoir disposed adjacent to said inner chamber, an oil pump disposed in said inner chamber and drivingly connected with said main shaft, said oil pump including an inlet port drawing the oil from said oil reservoir and an outlet port delivering the oil under the pressure corresponding to the speed of said main shaft, and presser actuating means provided between said oil pump and said presser foot, said presser actuating means applying an additional downward pressure to said presser foot by means of the oil from said outlet port so as to increase the downward pressure of said presser foot.

2. A sewing machine according to claim 1, wherein said pressure imparting means consists of resilient pressure imparting means.

3. A sewing machine according to claim 1, which further comprises manual adjusting means for adjusting the pressure of said pressure imparting means.

4. A sewing machine according to claim 1, wherein said oil pump consists of a trochoid pump.

5. A sewing machine according to claim 1, wherein said presser actuating means includes an oil cylinder.

6. A sewing machine comprising;

a frame defining an inner chamber therein and having a work supporting surface thereon, a presser foot for downwardly depressing a work on said work supporting surface, resilient pressure imparting means for applying a downward pressure to said presser foot, a main shaft rotatably supported on said frame, an oil reservoir disposed adjacent to said inner chamber, an oil pump disposed in said inner chamber and drivingly connected with said main shaft, said oil pump including an inlet port drawing the oil from said oil reservoir and an outlet port delivering the oil under the pressure corresponding to the speed of said main shaft, and presser actuating means provided between said oil pump and said resilient pressure imparting means, said presser actuating means applying an additional downward pressure to said presser foot through said resilient pressure imparting means by means of the oil from said outlet port so as to increase the downward pressure of said presser foot.

7. A sewing machine comprising;

a frame defining an inner chamber therein and having a work supporting surface thereon, a presser foot for downwardly depressing a work on said work supporting surface, resilient pressure imparting means for applying a downward pressure to said presser foot, a main shaft rotatably supported on said frame, an oil reservoir disposed adjacent to said inner chamber, an oil pump disposed in said inner chamber and drivingly connected with said main shaft, said oil pump including an inlet port drawing the oil from said oil reservoir and an outlet port delivering the oil under the pressure corresponding to the speed of said main shaft, presser actuating means actuated by the oil from said outlet port of said oil pump, and resilient motion transmitting means interposed between said presser actuating means and said presser foot, said resilient motion transmitting means applying an additional downward pressure to said presser foot regardless of said resilient pressure imparting means upon the actuation of said presser actuating means so as to increase the downward pressure of said presser foot.

8. A sewing machine comprising;

a frame defining an inner chamber therein and having a work supporting surface thereon, a presser foot for downwardly depressing a work on said work supporting surface, pressure imparting means for applying a downward pressure to said presser foot, a main shaft rotatably supported on said frame, an oil reservoir disposed adjacent to said inner chamber, an oil pump disposed in said inner chamber and drivingly connected with said main shaft, said oil pump including an inlet port drawing the oil from said oil reservoir and an outlet port delivering the oil under the pressure corresponding to the speed of said main shaft, presser actuating means provided between said oil pump and said presser foot, said presser actuating means applying an additional downward pressure to said presser foot by means of the oil from said outlet port so as to increase the downward pressure of said presser foot, and control means for varying the increasing rate of said additional downward pressure relative to the speed of said main shaft.

9. A sewing machine according to claim 8, wherein said control means includes means for exhausting the oil delivered from said outlet port and manually operable control valve for vary the exhausting quantity of said oil.

10. A sewing machine comprising;

a frame defining an inner chamber therein and having a work supporting surface thereon, a presser foot for downwardly depressing a work on said work supporting surface, pressure imparting means for applying a downward pressure to said presser foot, a main shaft rotatably supported on said frame, an oil reservoir disposed adjacent to said inner chamber, a drive gear secured on said main shaft, a driven gear coupled with said drive gear and rotated around an axis upon the rotation of said drive gear, a first oil pump disposed in said inner chamber and having a pump shaft to which said driven gear is secured, said first oil pump including an inlet port drawing the oil from said oil reservoir and an outlet port delivering the oil to the moving parts of said sewing machine, a second oil pump disposed in said inner chamber and having a pump shaft to which said driven gear is also secured, said second oil pump including an inlet port drawing the oil from said oil reservoir and an outlet port delivering the oil under the pressure corresponding to the speed of said main shaft, and presser actuating means provided between said second oil pump and said presser foot, said presser actuating means applying an additional downward pressure to said presser foot by means of the oil from the outlet port of said second oil pump so as to increase the downward pressure of said presser foot.

11. A sewing machine comprising;

a frame defining an inner chamber therein and having a work supporting surface thereon, a presser foot for downwardly depressing a work on said work supporting surface, pressure imparting means for applying a downward pressure to said presser foot, a main shaft rotatably supported on said frame, an oil reservoir disposed adjacent to said inner chamber, and an oil pump disposed in said inner chamber and secured on said frame, said oil pump including (a) a pump casing secured on said frame and having a pump chamber therein, (b) a pump shaft rotatably supported on said pump casing and drivingly connected with said main shaft, (c) an inlet port drawing the oil from said oil reservoir into said pump chamber, (d) an outlet port delivering the oil from said pump chamber under the pressure corresponding to the speed of said main shaft, (e) a cylindrical chamber provided within said pump casing and coupling with said outlet port, and (f) a piston movably mounted within said cylindrical chamber for applying an additional downward pressure to said presser foot by means of the oil from said outlet port so as to increase the downward pressure of said presser foot.

* * * * *